US007999200B2

(12) United States Patent
Komori et al.

(10) Patent No.: US 7,999,200 B2
(45) Date of Patent: Aug. 16, 2011

(54) SAFETY SWITCH

(75) Inventors: Etsurou Komori, Osaka (JP); Takao Fukui, Osaka (JP); Takeo Yasui, Osaka (JP); Masaki Nobuhiro, Osaka (JP)

(73) Assignee: IDEC Corporation, Osaka (JP)

( * ) Notice: Subject to any disclaimer, the term of this patent is extended or adjusted under 35 U.S.C. 154(b) by 270 days.

(21) Appl. No.: 11/919,375

(22) PCT Filed: Apr. 5, 2006

(86) PCT No.: PCT/JP2006/307223

§ 371 (c)(1),
(2), (4) Date: Oct. 25, 2007

(87) PCT Pub. No.: WO2006/117965

PCT Pub. Date: Nov. 9, 2006

(65) Prior Publication Data

US 2010/0011818 A1 Jan. 21, 2010

(30) Foreign Application Priority Data

Apr. 26, 2005 (JP) ..... 2005-127454

(51) Int. Cl.
*H01H 27/00* (2006.01)

(52) U.S. Cl. ..... 200/43.04; 200/334; 200/324

(58) Field of Classification Search ..... 200/43.04, 200/323–325, 43.09, 334, 337; 335/132, 335/185, 195, 129–131
See application file for complete search history.

(56) References Cited

U.S. PATENT DOCUMENTS

| | | | | |
|---|---|---|---|---|
| 2,719,582 | A * | 10/1955 | Judson | 361/192 |
| 5,215,088 | A | 6/1993 | Normann et al. | |
| 5,420,385 | A | 5/1995 | Cooper | |
| 5,584,378 | A | 12/1996 | Wecke et al. | |
| 5,622,253 | A | 4/1997 | Wecke et al. | |
| 5,703,339 | A | 12/1997 | Rapp et al. | |
| 5,777,284 | A * | 7/1998 | Mohtasham | 200/43.04 |
| 5,821,484 | A | 10/1998 | Schulze et al. | |
| 5,959,270 | A | 9/1999 | Wecke et al. | |

(Continued)

FOREIGN PATENT DOCUMENTS

DE 44 03 061 C1 6/1995

(Continued)

OTHER PUBLICATIONS

Apr. 2004 Image of Solenoid Interlock AZM 161.

(Continued)

*Primary Examiner* — Felix O Figueroa
(74) *Attorney, Agent, or Firm* — Jordan and Hamburg LLP

(57) ABSTRACT

A safety switch is described in which a switching contact in a lock mechanism switches between an open and closed condition. Switching is coupled to a lock member moveable between a locked position, locking a drive cam, and an unlocked position, allowing the cam to rotate. A link member, cooperating with the lock member, switches between open and closed conditions of normally-open and normally-closed switching contacts, indicating movement of the lock member between the locked position and the unlocked position. By monitoring the open and closed conditions of the normally-open and normally-closed switching contacts, it is possible to determine the state of the lock member, i.e., whether it is in the locked position or in the unlocked position. It therefore can be determined whether the drive cam is in the locked or unlocked (i.e., free to rotate) state.

9 Claims, 12 Drawing Sheets

U.S. PATENT DOCUMENTS

| | | | | |
|---|---|---|---|---|
| 6,194,674 | B1 | 2/2001 | Fukui | |
| 6,307,167 | B1 | 10/2001 | Kajio et al. | |
| 6,310,305 | B1 | 10/2001 | Kamino et al. | |
| 6,627,827 | B2 | 9/2003 | Kiong Low et al. | |
| 6,720,508 | B2 * | 4/2004 | Moriyama et al. | 200/43.04 |
| 7,071,436 | B2 | 7/2006 | Coates | |
| 7,138,589 | B2 | 11/2006 | Tanaka et al. | |
| 7,339,125 | B2 | 3/2008 | Day | |
| 7,345,252 | B2 | 3/2008 | Takenaka et al. | |
| 7,429,708 | B1 | 9/2008 | Poyner et al. | |
| 7,504,597 | B2 | 3/2009 | Shimazu et al. | |
| 2002/0091421 | A1 | 7/2002 | Greenberg et al. | |
| 2002/0113701 | A1 | 8/2002 | Turk | |
| 2003/0005732 | A1 | 1/2003 | Moriyama et al. | |
| 2003/0100823 | A1 | 5/2003 | Kipke et al. | |
| 2003/0176905 | A1 | 9/2003 | Nicolelis et al. | |
| 2008/0121499 | A1 | 5/2008 | Komori et al. | |
| 2009/0065340 | A1 | 3/2009 | Komori et al. | |

FOREIGN PATENT DOCUMENTS

| | | | |
|---|---|---|---|
| DE | 20102819 | | 8/2002 |
| EP | 0 977 227 | | 2/2000 |
| EP | 1 465 700 | A2 | 10/2004 |
| JP | 58-154525 | | 10/1983 |
| JP | 62-40522 | | 10/1987 |
| JP | 3-50733 | | 5/1991 |
| JP | 05-068038 | | 3/1993 |
| JP | 05-068038 | | 9/1993 |
| JP | 06-076675 | | 3/1994 |
| JP | 06-163131 | | 6/1994 |
| JP | 06-163131 | | 10/1994 |
| JP | 07-254332 | | 10/1995 |
| JP | 9-507333 | | 7/1997 |
| JP | 9-245584 | | 9/1997 |
| JP | 10-334772 | | 12/1998 |
| JP | 2000-207979 | | 7/2000 |
| JP | 2002-140962 | | 5/2002 |
| JP | 2002-157944 | | 5/2002 |
| JP | 2002-367470 | | 12/2002 |
| JP | 2003-045294 | | 2/2003 |
| JP | 2003-331696 | | 11/2003 |
| JP | 2005-038664 | | 2/2005 |
| JP | 2005-38664 | | 2/2005 |

OTHER PUBLICATIONS

Apr. 2004 Schmersal, "Sicherheit im System: Schutz fuer Mensch und Maschine", Hauptkatalog Sicberheitstechnik, Ausgabe 02, Funktionsbeschreibung AZM 161, p. 1-20 und 1-21.

* cited by examiner

FIG. 5A1: NORMALLY-OPEN SWITCHING CONTACT: UNLOCK POSITION
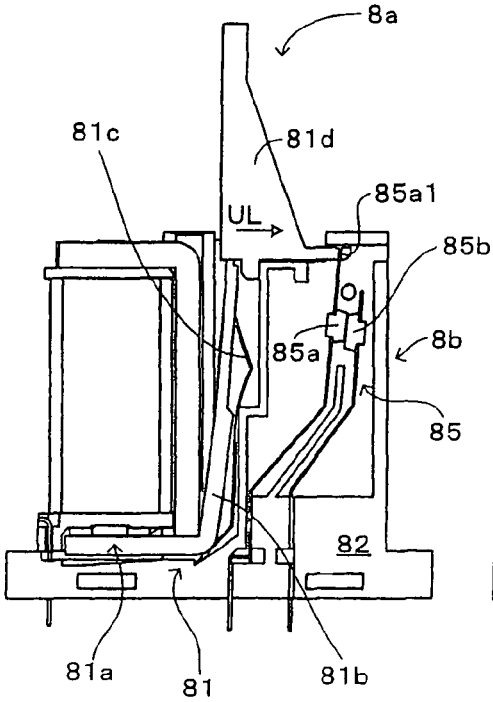
FIG. 5A2: NORMALLY-OPEN SWITCHING CONTACT: LOCK POSITION
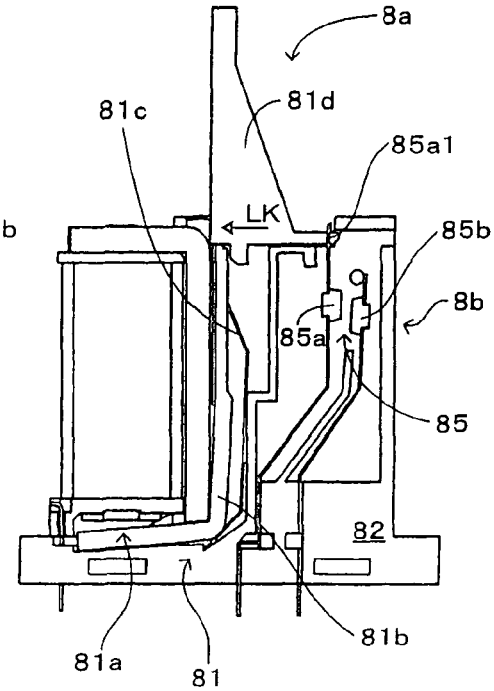
FIG. 5B1: NORMALLY-CLOSED SWITCHING CONTACT: UNLOCK POSITION
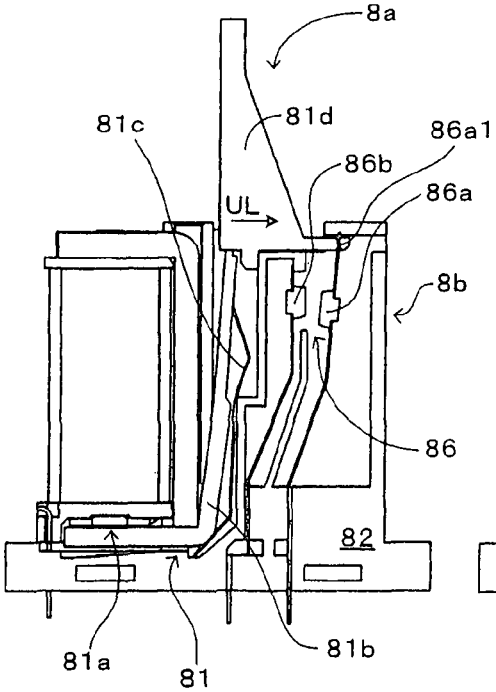
FIG. 5B2: NORMALLY-CLOSED SWITCHING CONTACT: LOCK POSITION
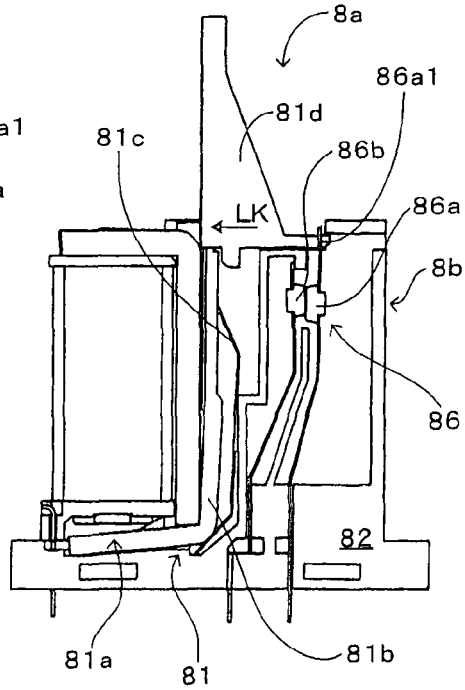

FIG. 8A: NORMALLY-CLOSED SWITCHING CONTACT: LOCK POSITION

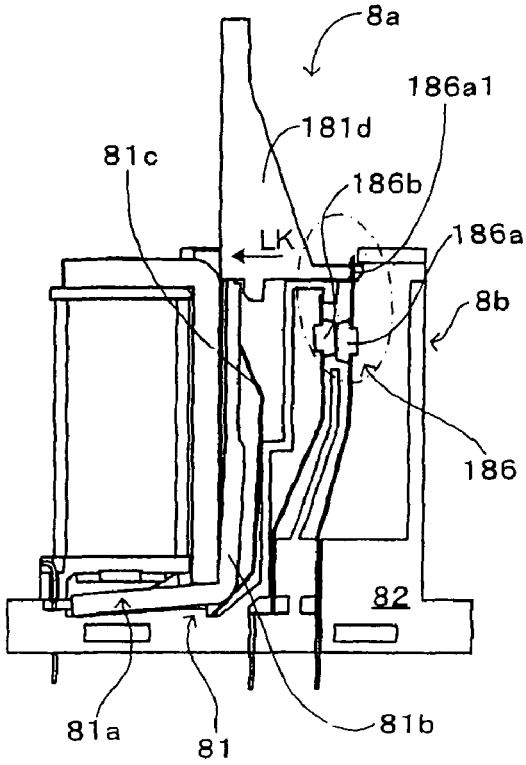

FIG. 8B: NORMALLY-CLOSED SWITCHING CONTACT: LOCK POSITION (POWER SUPPLY TO ELECTROMAGNET SHUT OFF)

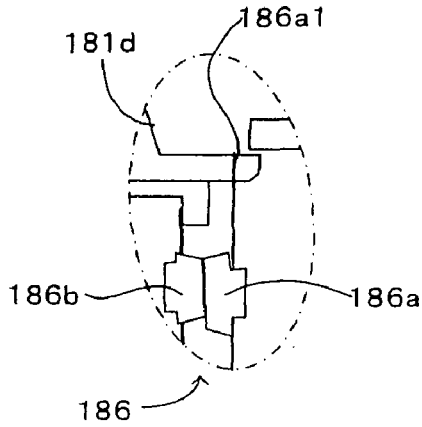

FIG. 8C: NORMALLY-CLOSED SWITCHING CONTACT: LOCK POSITION (DURING ENERGIZATION OF ELECTROMAGNET) (FUSED CONTACT)

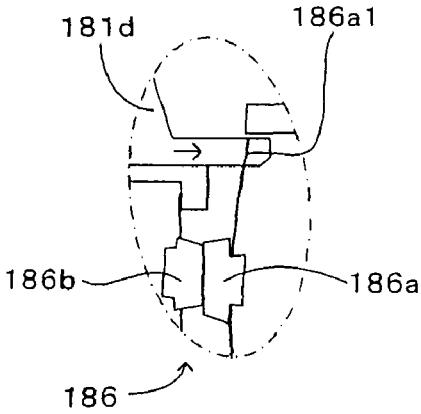

FIG. 8D: NORMALLY-CLOSED SWITCHING CONTACT: LOCK POSITION (DURING ENERGIZATION OF ELECTROMAGNET) (NON-FUSED CONTACT)

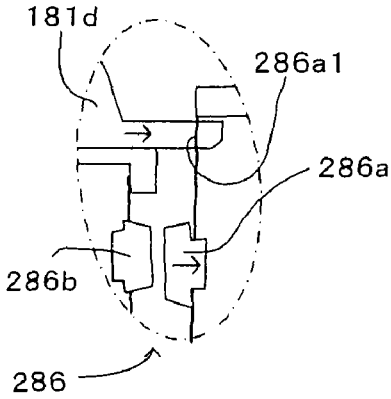

FIG. 9A: NORMALLY-CLOSED SWITCHING CONTACT: LOCK POSITION

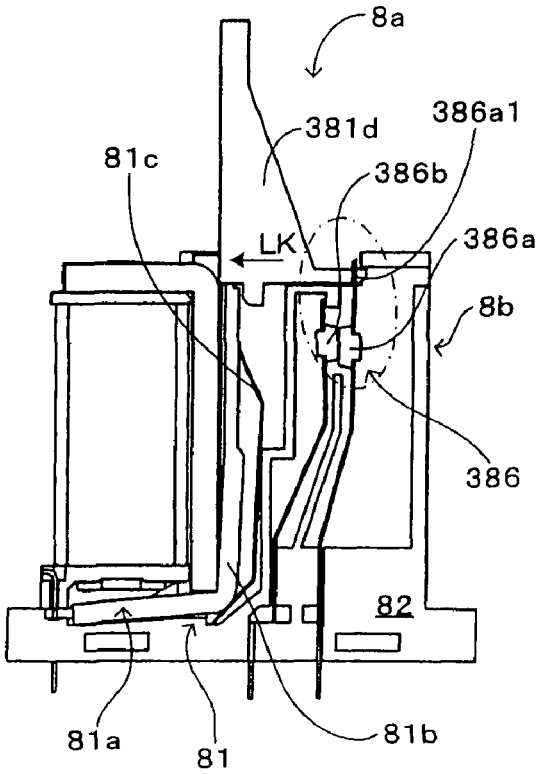

FIG. 9B: NORMALLY-CLOSED SWITCHING CONTACT: LOCK POSITION (POWER SUPPLY TO ELECTROMAGNET SHUT OFF)

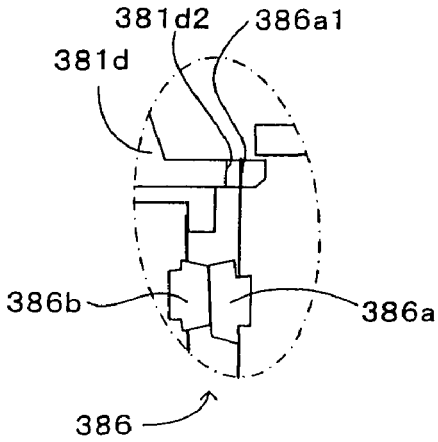

FIG. 9C: NORMALLY-CLOSED SWITCHING CONTACT: LOCK POSITION (DURING ENERGIZATION OF ELECTROMAGNET) (FUSED CONTACT)

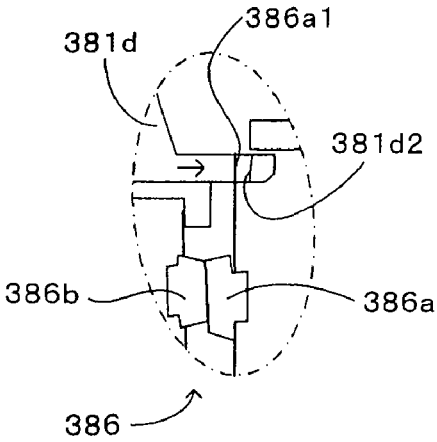

FIG. 9D: NORMALLY-CLOSED SWITCHING CONTACT: LOCK POSITION (DURING ENERGIZATION OF ELECTROMAGNET) (NON-FUSED CONTACT)

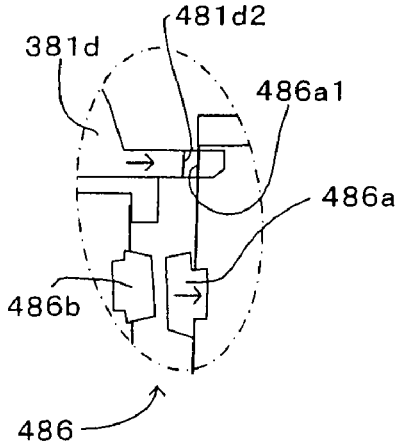

FIG. 10A: NORMALLY-OPEN SWITCHING CONTACT: UNLOCK POSITION

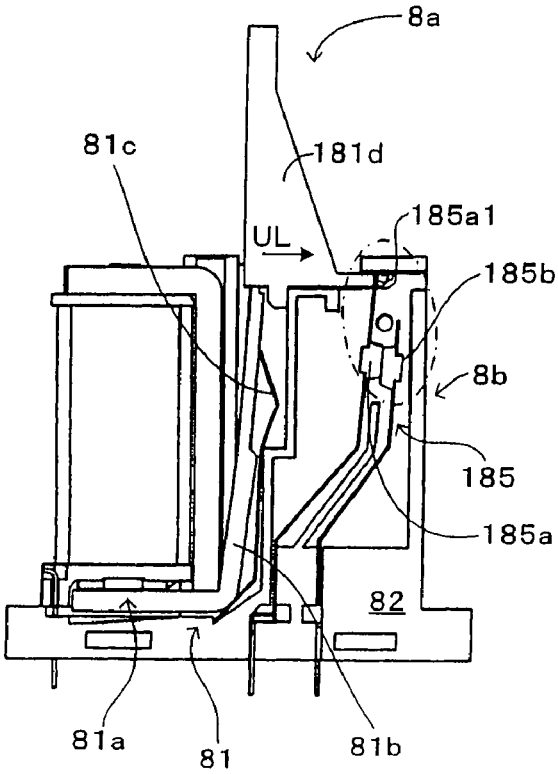

FIG. 10B: NORMALLY-OPEN SWITCHING CONTACT: UNLOCK POSITION (DURING ENERGIZATION OF ELECTROMAGNET)

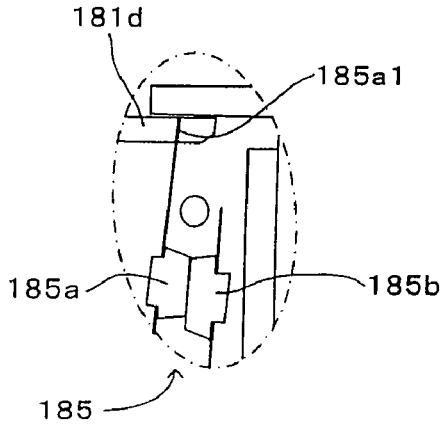

FIG. 10C: NORMALLY-OPEN SWITCHING CONTACT: UNLOCK POSITION (POWER SUPPLY TO ELECTROMAGNET SHUT OFF) (FUSED CONTACT)

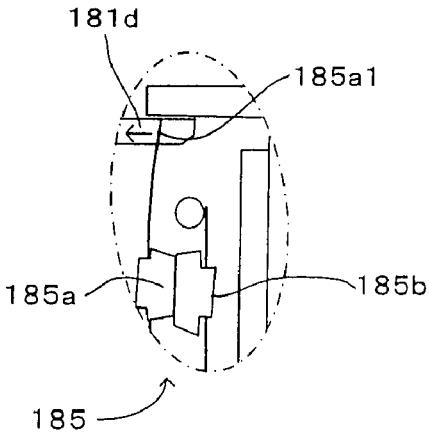

FIG. 10D: NORMALLY-OPEN SWITCHING CONTACT: UNLOCK POSITION (POWER SUPPLY TO ELECTROMAGNET SHUT OFF) (NON-FUSED CONTACT)

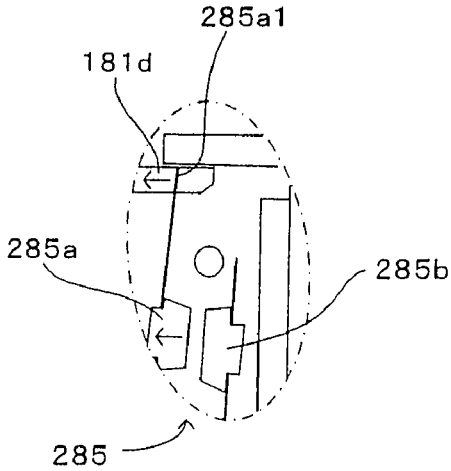

FIG. 11A: NORMALLY-OPEN SWITCHING CONTACT: UNLOCK POSITION

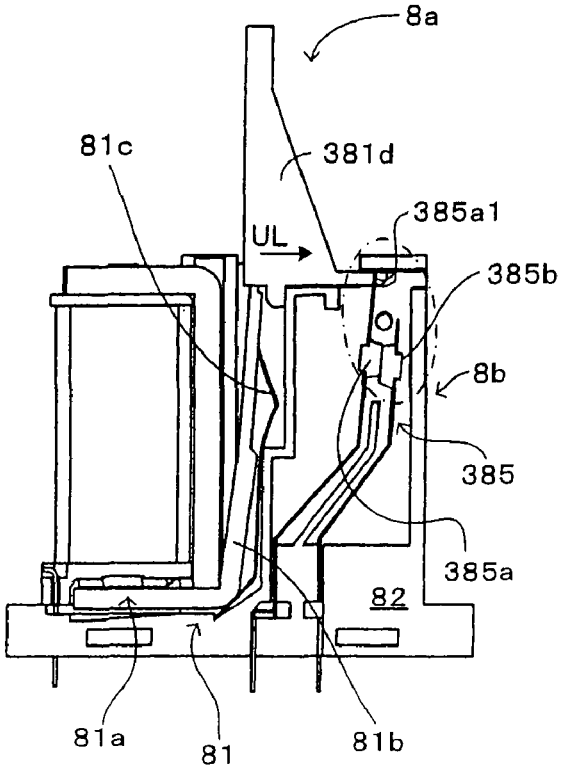

FIG. 11B: NORMALLY-OPEN SWITCHING CONTACT: UNLOCK POSITION (DURING ENERGIZATION OF ELECTROMAGNET)

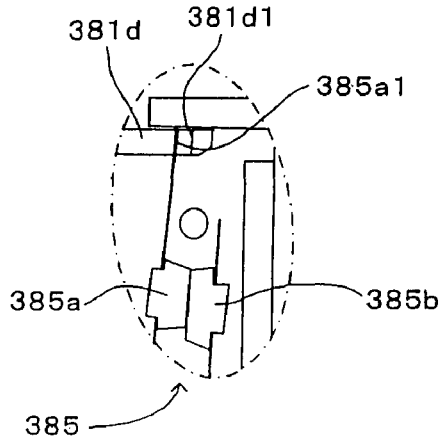

FIG. 11C: NORMALLY-OPEN SWITCHING CONTACT: UNLOCK POSITION (POWER SUPPLY TO ELECTROMAGNET SHUT OFF) (FUSED CONTACT)

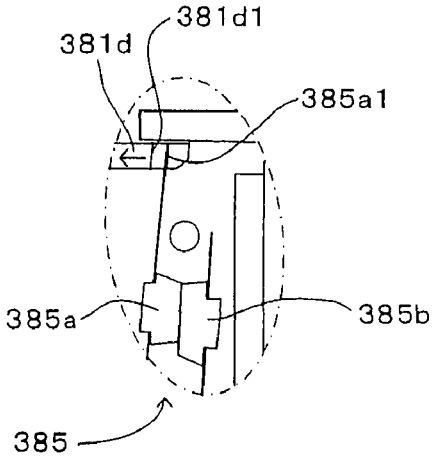

FIG. 11D: NORMALLY-OPEN SWITCHING CONTACT: UNLOCK POSITION (POWER SUPPLY TO ELECTROMAGNET SHUT OFF) (NON-FUSED CONTACT)

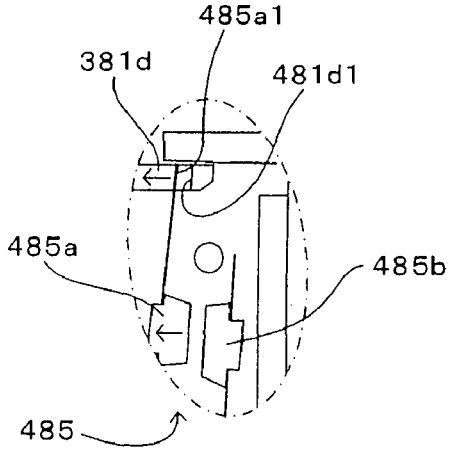

SAFETY SWITCH

BACKGROUND OF THE INVENTION

The present invention relates to a safety switch mounted on a peripheral wall surface of a protective door of, for example, industrial machinery etc., and stopping a supply of power to the industrial machinery etc. when the protective door is opened.

Conventionally, the protective door etc. of industrial machinery has been provided with a safety switch preventing the machinery from being driven in situations where the protective door is not fully closed in order to avert accidents wherein a worker is injured as a result of entrapment in the machinery. As an example of this type of safety switch, the safety switch disclosed in Patent Document 1 is provided with a lock mechanism that mechanically locks an actuator in the safety switch after the actuator having been inserted thereinto, thus preventing extraction of the operating key.

The safety switch provided with this lock mechanism is configured such that, for example, by providing an actuator in a protective door in the form of protrusion, and the switch main unit in the position where the actuator is inserted into the switch main unit through an insertion opening with the protective door closed, the actuator is inserted into the switch main unit through the insertion opening when the protective door is closed. Then, a cam-like plate (driving cam) is rotated as a result of insertion of the actuator, and as a result of the cam-like plate rotating, a cam follower pin that is in sliding contact along the respective cam openings are guided to a guide portion of a pin guide plate. A switching member, which integrally includes the cam follower pin, is caused to move as well so that a switching section is switched.

Also when the cam-like plate rotates as a result of insertion of the actuator, a locking bar of a lock lever (lock member) that is rotationally urged by an elastic member constantly abuts while making sliding contact with the cam-like plate in a substantially circular shape. When the cam-like plate is rotated to the position capable of switching the switch section, the lock lever rotates so that the locking bar opposes and engages with an engaging step section. Accordingly, the rotation of the cam-like plate as a result of motion of the actuator toward a withdrawal direction is blocked by the engaging step section abutting the locking bar, which mechanically locks the actuator to prohibit motion thereof toward a withdrawal direction, namely opening of a protective door. Then, for example, when the industrial machinery stops and a solenoid provided in a solenoid unit of the lock mechanism is operated due to input of a signal detecting the stoppage, the lock lever is operated against a urging force of the elastic member by the working rod of the solenoid, and the locking bar moves away from the engaging step section, thereby releasing the lock.

Next, the solenoid unit is described in detail with reference to FIG. 13. As shown in FIG. 13, a normally-open switching contact 124 and a normally-closed switching contact 125, which open and close in a manner coupled with the motion of the working rod 127*a* that moves as a result of the solenoid 127 being operated, and respectively become in an open and a closed in a locked state, which is a condition when a supply of power to the solenoid 127 is shut off. Also, an operation member 127*b* is connected to the working rod 127*a*, and the operation member 127*b* is engaged with a lock lever 127*c*. The operation member 127*b* moves pursuant to the motion of the working rod 127*a* that moves as a result of the solenoid 127 being operated, and the lock lever 127*c* moves in a coupled manner with the motion of the operation member 127*b*, and the engagement condition between the locking bar of the lock lever 127*c* and the engaging step section is released. It should be noted that FIG. 13 is a cross-sectional view showing a solenoid unit of a conventional safety switch.

Operations of the normally-open and normally-closed switching contacts 124 and 125, the operation member 127*b*, and the lock lever 127*c* are described in detail. Each of the normally-open and normally-closed switching contacts 124 and 125 includes a movable contact and a fixed contact. They are also provided with a first and a second link member, respectively, for moving the movable contacts by transmitting the motion of the working rod 127*a* of the solenoid 127 to the movable contacts. When the solenoid 127 is energized, the working rod 127*a* moves in the direction of the arrow ON and along with this the first and second link members also move in the direction of the arrow ON, and accordingly the movable contacts also move in the direction of the arrow ON. As a result, the movable contact and the fixed contact of the normally-open switching contact 124 contact each other, thereby putting the normally-open switching contact 124 in a closed condition, while the movable contact and the fixed contact of the normally-closed switching contact 125 are separated, thereby putting the normally-closed switching contact 125 in an open condition. Then, along with the working rod 127*a* moving in the direction of the arrow ON, the operation member 127*b* also moves in the direction of arrow ON. Pursuant to the motion of the operation member 127*b* in the direction of the arrow ON, the lock lever 127*c* engaged with the operation member 127*b* moves so that the safety switch becomes an unlocked state. Also, when a supply of power to the solenoid 127 is cutoff, along with the working rod 127*a* moving in the direction opposite to the arrow ON due to the urging force of a return spring (not shown), the first and second link members and the movable contacts move in the same direction as the moving direction of the working rod 127*a*, thereby putting the normally-open and normally-closed switching contacts 124 and 125 in an open and a closed condition, respectively. In addition, the operation member 127*b* moves in the same direction as the working rod 127*a*, and the lock lever 127*c* moves in a coupled manner with the motion of the operation member 127*b*. As a result, the locking bar of the lock lever 127*c* and the engaging step section become engaged so that the safety switch becomes a locked state. By monitoring the open-close conditions of the normally-open and normally-closed switching contacts 124 and 125, the lock condition of the lock mechanism can be detected.

Patent Document 1: JP H6-76675A ([0008] to [0009], FIG. 1)

SUMMARY OF THE INVENTION

Incidentally, in the above-described conventional safety switch, the open-close conditions of the normally-open and normally-closed switching contacts 124 and 125 are switched as a result of the working rod 127*a*, the operation member 127*b* and the lock lever 127*c* moving in a coupled manner, so that the lock condition of the lock mechanism can be detected. Thus, in the conventional safety switch, since the lock member (lock lever 127*c*) is not directly connected to the first and second link members (the normally-open and normally-closed switching contacts 124 and 125), the following problem has sometimes occurred. That is, since the lock member is connected to the first and second link members via the working rod 127*a* and the operation member 127*b*, for example, the engagement condition between the operation member 127*b* and the lock member may be released or become loose, so that the lock member and the first and second link members may fail to move in a coupled manner. As a result, when the solenoid 127 is energized, the operation member 127*b* and the lock member do not move in a coupled manner, so that the open-close conditions of the normally-open and normally-closed switching contacts 124 and 125 are normally switched so as to indicate the unlocked state, although the engagement condition between the lock member and the engaging step section is not released. In addition, when a supply of power to the solenoid 127 is shutoff, the operation member 127*b* and the lock member do not move in a coupled manner, so that the normally-open and normally-closed switching contacts 124 and 125 are normally switched so as to indicate the locked state, although the engagement condition between the lock member and the engaging step section is released. In this manner, even if a problem has occurred to the connection between the lock member and both switching contacts, the switching contacts operate normally depending on the condition of energization of the solenoid 127. Therefore, it has been sometimes impossible to determine whether the lock mechanism is in a locked state or an unlocked state only by monitoring the open-close conditions of the normally-open and normally-closed switching contacts 124 and 125.

The present invention has been achieved in view of the above-described problems, and the object thereof is to provide a safety switch in which the open-close conditions of the switching contacts provided in the lock mechanism are reliably switched in a manner coupled with the motion of the lock member between a lock position and an unlock position.

As a means of resolving the above-explained problems, the safety switch according to the present invention is a safety switch provided with an actuator capable of freely entering/withdrawing from an operation section of a switch main unit, in which a switch section side switching contact becomes an open condition/a closed condition as result of an operating rod provided in a switch section reciprocating in response to the entry/withdrawal of the actuator, so that the entry/withdrawal of the actuator is detected, includes a drive cam provided in the operation section and capable of freely rotating, and a lock mechanism provided in a lock mechanism section of the switch main unit that locks rotation of the drive cam, wherein the drive cam rotates forward and backward in response to the entry/withdrawal of the actuator with respect to the operation section, and the operating rod reciprocates due to the forward and backward rotation, and the lock mechanism includes a lock member provided capable of freely moving between a lock position and an unlock position, that moves to the lock position when the actuator is in the entry condition so as to lock the rotation of the drive cam, and moves to the unlock position so as to release the locked state of the rotation of the drive cam; a drive section that moves the lock member; at least one lock mechanism side switching contact; and a link member that switches an open-close condition of the lock mechanism side switching contact in a manner coupled with the motion of the lock member.

With such a configuration, the drive cam rotates forward and backward pursuant to entry and withdrawal of the actuator with respect to the operation section of the switch main unit, and the operating rod reciprocates pursuant to this rotation of the drive cam in both directions, so that the switch section side switching contacts open/close pursuant to the reciprocation of the operating rod. Then, when the actuator is in an entry state, the rotation of the drive cam is locked by the drive section of the lock mechanism causing the lock member to move to the lock position, and the locked state of the rotation of the drive cam is released by causing the lock member to move to the unlock position. In addition, since the link member directly switches the open-close conditions of the lock mechanism side switching contacts provided in the lock mechanism in a manner pursuant to the motion of the lock member, the open-close conditions of the lock mechanism side switching contacts can be reliably switched in a manner coupled with the motion of the lock member between the lock position and the unlock position. Further, since the link member switches the open-close conditions of the lock mechanism side switching contacts provided in the lock mechanism in a manner coupled with the motion of the lock member between the lock position and the unlock position, for example, by monitoring the open-close conditions of the lock mechanism side switching contacts provided in the lock mechanism, it is possible to determine to which of the lock position and the unlock position the lock member has moved, that is, which of the locked state and the unlocked state the rotation of the drive cum is in.

Also, a configuration can also be such that the lock mechanism includes two or more the lock mechanism side switching contacts, and the link member is provided connecting the lock member and respective movable contacts of the lock mechanism side switching contacts. With such a configuration, since the lock member is directly connected to the respective movable contacts of two or more lock mechanism side switching contacts via the link member, the link member moves pursuant to the motion of the lock member, and the movable contacts of the lock mechanism side switching contacts reliably move pursuant to the motion of the link member. As a result, the open-close conditions of these lock mechanism side switching contacts can be reliably and simultaneously switched in a manner coupled with the motion of the lock member between the lock position and the unlock position. Therefore, for example, as so-called double countermeasures, it can be reliably determined which of the locked state and the unlocked state the rotation of the drive cum is in, by simultaneously monitoring the open-close conditions of these lock mechanism side switching contacts.

Also, a configuration can also be such that the lock mechanism includes a normally-open switching contact and a normally-closed switching contact as the two or more lock mechanism side switching contacts, and the link member is provided connecting the lock member and respective movable contacts of the normally-open switching contact and the normally-closed switching contact. With such a configuration, since the lock member is connected to the link member, the link member moves pursuant to the motion of the lock member. The movable contacts of the normally-open and normally-closed switching contacts are connected to the link member, and therefore the respective movable contacts of the normally-open and normally-closed switching contacts simultaneously move pursuant to the motion of the link member. For this reason, the open-close conditions of the normally-open and normally-closed switching contacts can be reliably and simultaneously switched in a manner coupled with the motion of the lock member. In addition, for example, when fusion occurs to one of the normally-open and normally-closed switching contacts so that the movable contact thereof cannot move normally, the link member connected to the fused movable contact cannot move either. Accordingly, the movable contact of the other normal switching contact connected in a similar manner to the link member does not move either. Thus, when a problem occurs to one of the switching contacts, the other switching contact can be prevented from operating normally, which makes it possible that the normally-open and normally-closed switching contacts reliably maintain the opposite open-close conditions.

A configuration can also be such that the drive section includes a hinge-type electromagnet provided in the lock mechanism section, with a working member displaced due to electromagnetic force of attraction generated by energization, and a transmission section that moves the lock member by transmitting the displacement of the working member to the lock member. With such a configuration, the drive section transmits to the lock member via the transmission section the displacement of the working member caused by the electromagnetic force of attraction generated by energizing the hinge-type electromagnet, so as to move the lock member. In this way, since the displacement of the working member caused by the electromagnetic force of attraction generated by energizing the hinge-type electromagnet is transmitted to the lock member via the transmission section so as to move the lock member, in comparison to usage of the electromagnetic force of attraction in a straight-line fashion such as by a plunger-type electromagnet, it is possible to provide a thin and compact safety switch.

A configuration can also be such that the link member functions as the transmission section, the working member engages with a part of the link member, the displacement of the working member is transmitted to the lock member and the lock mechanism side switching contacts via the link member. With such a configuration, since the electromagnetic force of attraction generated by energizing the hinge-type electromagnet is transmitted to the lock member and the lock mechanism side switching contacts via the link member engaged with the working member, it is possible to reliably open/close the lock mechanism side switching contacts using a fewer components.

Furthermore, a configuration can also be such that the switch main unit has a rectangular parallelepiped shape, and an actuator entry opening is formed at one of a pair of opposing corner portions of the switch main unit, and a cable extraction opening is formed at the other, and a cable is extracted from the cable extraction opening substantially in a direction of joining the pair of opposing corner portions. With such a configuration, the relationship between the actuator entry opening and the cable extraction opening realizes a high degree of freedom in terms of a cable extraction direction, and therefore the safety switch can be provided on a wall surface or on a protective door, and furthermore, the actuator entry opening can be arranged so as to be horizontal or vertical. Furthermore, either a front or rear surface of the safety switch can be attached to the mounting location. Accordingly, a degree of freedom with regard to mounting of the safety switch is increased, and a wider range of safety switch mounts is available.

Furthermore, a configuration is possible in which the switch section side switching contacts are connected electrically within the switch main unit to an end portion of an external connection cable, and an entry and withdrawal conditions of the actuator are detected based on an electrical signal resulting from opening and closing of the contacts of the switch section side switching contacts. As a result of such a configuration, entry and withdrawal of the actuator can be detected from the exterior based on an electrical signal resulting from opening and closing of the contacts of the switch section side switching contacts.

Furthermore, a configuration can also be such that at least the lock member of the lock mechanism is provided as a unit and arranged so as to be capable of being freely built into and removed from the drive section. With such a configuration, since the lock member is provided as a unit and arranged so as to be capable of being freely built into and removed from the drive section, even in a situation in which the lock member breaks, it is sufficient to replace this unit in order to restore the safety switch efficiently and in a short period of time.

As described above, according to a first aspect of the present invention, since the link member directly switches the open-close conditions of the lock mechanism side switching contacts provided in the lock mechanism pursuant to the motion of the lock member, the open-close conditions of the lock mechanism side switching contacts can be reliably switched in a coupled manner with the motion of the lock member between the lock position and the unlock position. Therefore, since the link member reliably switches the open-close conditions of the lock mechanism side switching contacts provided in the lock mechanism in a manner coupled with the motion of the lock member between the lock position and the unlock position, for example, by monitoring the open-close conditions of the lock mechanism side switching contacts provided in the lock mechanism, it is possible to determine to which of the lock position and the unlock position the lock member has moved, that is, which of the locked state and the unlocked state the rotation of the drive cum is in.

According to a second aspect of the present invention, the lock member is directly connected to the respective movable contacts of the two or more lock mechanism side switching contacts via the link member. Therefore, when the link member moves pursuant to the motion of the lock member, the movable contacts of the lock mechanism side switching contacts reliably move pursuant to the motion of the link member. As a result, the open-close conditions of these lock mechanism side switching contacts can be reliably and simultaneously switched in a manner coupled with the motion of the lock member between the lock position and the unlock position.

According to a third aspect of the present invention, by connecting the lock member, the link member and the respective movable contacts of the normally-open and normally-closed switching contacts, the open-close conditions of the normally-open and normally-closed switching contacts can be reliably and simultaneously switched in a manner coupled with the motion of the lock member. In addition, for example, when fusion occurs to the contact of one of the normally-open and normally-closed switching contacts so that the movable contact thereof cannot move normally, the link member connected to the fused movable contact cannot move either. Accordingly, the movable contact of the other normal switching contact connected in a similar manner to the link member does not move either, and the normally-open and normally-closed switching contacts reliably maintain the opposite open-close conditions.

According to a fourth aspect of the present invention, the drive section transmits to the lock member via the transmission section the displacement of the working member caused by the electromagnetic force of attraction generated by energizing the hinge-type electromagnet so as to move the lock member. Therefore, in comparison to usage of the electromagnetic force of attraction in a straight-line fashion such as by a plunger-type electromagnet, it is possible to provide a thin and compact safety switch.

According to a fifth aspect of the present invention, since the electromagnetic force of attraction generated by energizing the hinge-type electromagnet is transmitted to the lock member and the lock mechanism side switching contacts via the link member engaged with the working member, it is possible to reliably open/close the lock mechanism side switching contacts using a fewer components.

According to a sixth aspect of the present invention, the relationship between the actuator entry opening and the cable extraction opening makes it possible for the safety switch to be provided on a wall surface or on a protective door, and in addition, the actuator entry opening can be arranged so as to be horizontal or vertical. Furthermore, either a front or rear surface of the safety switch can be attached to the mounting location. Accordingly, a degree of freedom with regard to mounting of the safety switch is increased, and a wider range of safety switch mounts is available.

BRIEF DESCRIPTION OF DRAWINGS

FIGS. 5A1 to 5B2 are a cross-sectional view of a lock switching contact section according to the first embodiment of the present invention.

FIGS. 8A to 8D are a cross-sectional view of a lock switching contact section according to a third embodiment of the present invention.

FIGS. 9A to 9D are a cross-sectional view of a lock switching contact section according to a fourth embodiment of the present invention.

FIGS. 10A to 10D are a cross-sectional view of a lock switching contact section according to another embodiment of the present invention.

FIGS. 11A to 11D are a cross-sectional view of a lock switching contact section according to another embodiment of the present invention.

DETAILED DESCRIPTION OF THE INVENTION

First Embodiment

Figure 6A:
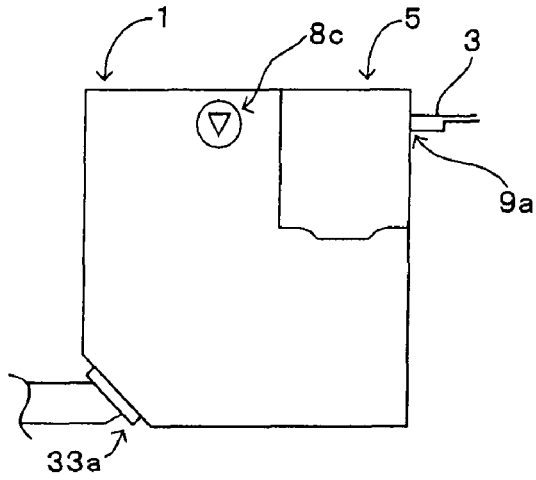
FIGS. 6A and 6B are an external view of a safety switch according to the first embodiment of the present invention.
Figure 6B:
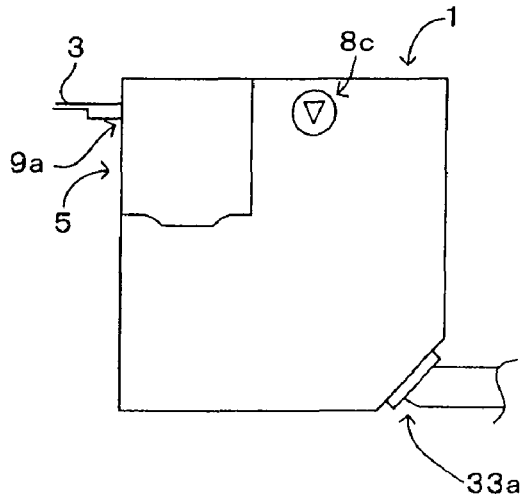

The following is a description of a first embodiment of the present invention with reference to drawings FIGS. 1 to 6B. FIGS. 1 to 4 illustrate cross-sectional views of a switch main unit, and FIGS. 5A1 to 5B2 illustrate a cross-sectional view of a lock switching contact section, and FIGS. 6A and 6B illustrate an exterior view of a safety switch.

Figure 1:
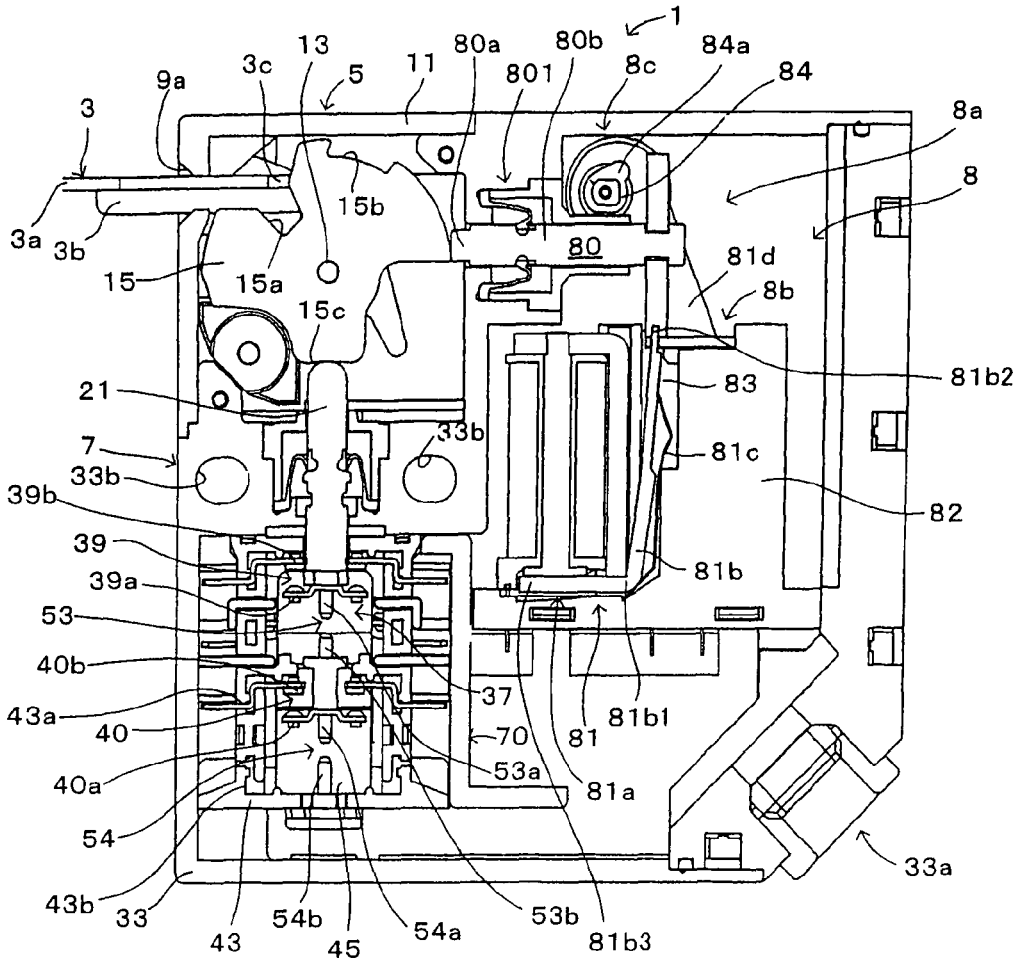
FIG. 1 is a cross-sectional view of a switch main unit according to a first embodiment of the present invention.

A safety switch according to the present invention is, in almost the same way as the above-explained conventional item, a switch connected electrically via a cable to an external device in the form of industrial machinery such as a robot etc., and as shown in FIG. 1, includes a switch main unit 1 and an actuator 3.

At this time, the switch main unit 1 includes an operation section 5, a switch section 7, and a lock mechanism section 8, and is fixed to a peripheral wall surface of a protective door of industrial machinery, omitted from the drawings. Furthermore, the actuator 3 is fixed to the protective door at a position opposing an actuator entry opening 9*a* formed in a side face of the operation section 5, and when the protective door is closed, the actuator 3 enters the actuator entry opening 9*a* of the operation section 5. It should be noted that the actuator 3 includes, as shown in FIG. 1, a base 3*a*, a pair of pressing pieces 3*b* protruding from the base 3*a*, and a connecting piece 3*c* mutually connecting these pressing pieces 3*b*. At this time, in contrast to a planar pressing piece of an actuator having a large width and small thickness, both pressing pieces 3*b* have a small width and large thickness, and a cross-section wherethrough the connecting piece 3*c* passes forms a sideway U-shape.

The operation section 5 disposed at a top-left portion of the switch main unit 1 includes, as shown in FIGS. 1 to 4, a case member 11 and a drive cam 15 having a rotating shaft 13 pivotably supported on an inner surface of this case member 11 and supported so as to be capable of freely rotating. At an upper portion of an outer peripheral surface of this drive cam 15, an engaging section 15*a* wherein the connecting piece 3*c* of the actuator 3 is fit by insertion is formed at a position that can be seen via the above-explained actuator entry opening 9*a*. In addition, a notch cut-out section 15*b* engaging with a lock member 80 of a lock mechanism section 8 explained hereinafter is formed at an upper portion of the outer peripheral surface of this drive cam 15. Furthermore, a cam curve section 15*c* is formed at a bottom portion of the outer peripheral surface of the drive cam 15, and a semispherical tip of an operating rod 21 having a tip portion protruding so as to be capable of freely entering and withdrawing with respect to the operation section 5 from the switch section 7 disposed below the operation section 5 slide-contacts with the cam curve section 15*c* of the drive cam 15. Also, when the operating rod 21 reciprocates entry and withdrawal movement pursuant to rotation of the drive cam 15, an open-close condition of a switching contact of a switching contact section 70 integrated into the switch section 7 is switched.

Next, the switch section 7 is explained. This switch section 7 includes, as shown in FIG. 1, the switching contact section 70 disposed inside a case member 33 that forms a switch main unit 1 of a rectangular parallelepiped shape integrated with the case member 11 and below the operation section 5, in which switch section side switching contacts are integrated, and the above-explained operating rod 21. Furthermore, it is configured such that a side of the case member 11 towards the operation section 5 can be mounted on this case member 33 so as to be freely attachable and detachable. In addition, a cable extraction opening 33*a* of a cable for external connection is formed in a corner portion at a side towards the case member 33 opposing a corner portion at a side towards the case member 11 wherein the actuator entry opening 9*a* is formed. Furthermore, as shown in FIG. 1, a pair of mounting holes 33*b* wherein bolts for mounting the switch main unit 1 onto a peripheral wall surface of a protective door of industrial machinery are inserted is formed in the outer surface of the case member 33.

It should be noted that a movable member 37 contacting another end portion of the operating rod 21 and capable of moving integrally with the operating rod 21, and first and second normally-closed switching contacts 39, and 40 opening and closing in a coupled manner with this movable member 37 are provided in the switching contact section 70. The normally-closed switching contacts 39 and 40 include movable contacts 39*a* and 40*a*, and fixed contacts 39*b* and 40*b*, respectively, each of the movable contacts 39*a* and 40*a* is fixed to the movable member 37, and each of the fixed contacts 39*b* and 40*b* is fixed to a frame member 43 provided in the switching contact section 70. Here, one of the normally-closed switching contacts 39 and 40, for example, the normally-closed switching contact 39, is for providing and cutting off a supply of power to the industrial machinery and is connected in series with a normally-closed switching contact 86 provided in the lock mechanism section 8 explained hereinafter. Furthermore, the normally-closed switching contact 40 is for monitoring the open-close conditions of these switching contacts for providing and cutting off a supply of power.

Also, the movable member 37 includes a planar base section 45 and a first mounting section 53 and a second mounting section 54 arranged vertically at both ends of one face of this base section 45 (the surface side of FIG. 1). One end side thereof is in contact with the other end of the operating rod 21 and a coil spring (not shown) is mounted on that other end side thereof; and the movable member 37 is urged in a direction of the operation section 5, that is, in an upward direction, by the coil spring. Furthermore, a pair of protrusions 53*a* and 53*b* and a pair of protrusions 54*a* and 54*b* are provided on the mounting sections 53 and 54, respectively, so as to be mutually opposed in a longitudinal direction of the movable member 37.

Figure 2:
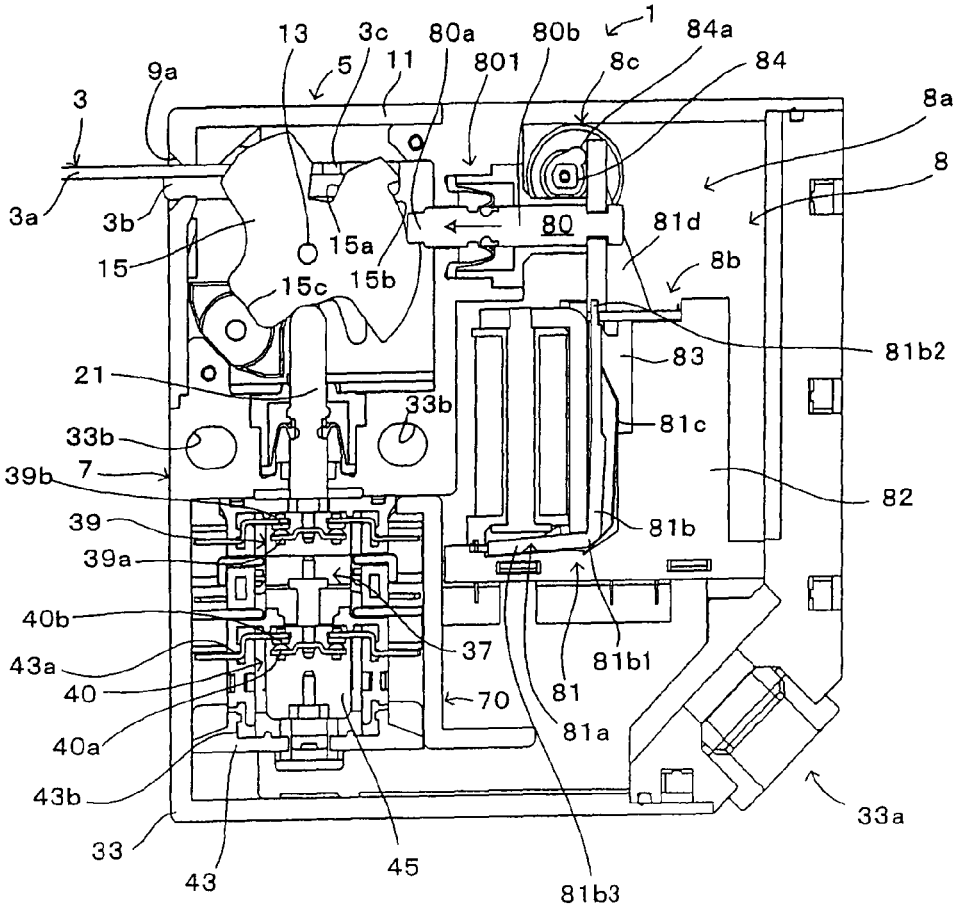
FIG. 2 is a cross-sectional view of the switch main unit according to the first embodiment of the present invention.

Also, the movable contacts 39*a* and 40*a* of the first and second normally-closed switching contacts 39 and 40 are each mounted so as to be freely attachable and detachable on a foot portion of one of each pair of the protrusions, namely, the protrusions 53*a* and 54*a*. The movable contacts 39*a* and 40*a* are fixed in a pressed manner on the mounting sections 53 and 54 respectively, by a spring (not shown) externally fitted on each of the protrusions 53*a*, 53*b*, 54*a*, 54*b*, and through an action of these springs, as shown in FIG. 2 in particular, a contact force is produced between the movable contacts 39*a* and 40*a* and the fixed contacts 39*b* and 40*b*, respectively.

Here, a cable (not shown) connected electrically to the industrial machinery is attached to the case member 33, and the cable and each of the normally-closed switching contacts 39 and 40 are connected electrically within the switching contact section 70. Detection of entry and withdrawal of the actuator 3 with respect to the operation section 5, and provision and cutting off of a supply of power to the industrial machinery can be carried out using an electrical signal resulting from opening and closing of each of the normally-closed switching contacts 39 and 40.

It should be noted that the fixed contact 40*b* of the second normally-closed switching contact 40 is, as shown in FIG. 1, mounted so as to be freely attachable and detachable on a normally-closed switching contact mounting section 43*a* formed in the frame member 43 of the switching contact section 70, is mounted such that the mounting position and mounting condition thereof can be changed together with those of the movable contact 40*a*, and therefore the second normally-closed switching contact 40 can be switched to a normally-open switching contact.

That is to say, in addition to the above-explained normally-closed switching contact mounting section 43*a*, a normally-open switching contact mounting section 43*b* on which the fixed contact 40*b* can mounted so as to be freely attachable and detachable is formed on the frame member 43, and the second normally-closed switching contact 40 can be switched to a normally-open switching contact by removing the moveable terminal 40*a* of the second normally-closed switching contact 40 from one of the protrusions 54*a* and mounting on the side of the other protrusion 54*b*, and removing the fixed contact 40*b* from the normally-closed switching contact mounting section 43*a* and mounting on the normally-open switching contact mounting section 43*b*. In this way, as this normally-open switching contact performs an opposite open-close operation to that of the first normally-closed switching contact 39, it can be used as a switching contact for monitoring of a different operation to that in the case of the second normally-closed switching contact 40, and the configuration as the normally-open or normally-closed switching contact can be selected in accordance with intended use.

It should be noted that, in a condition of FIG. 1 wherein the actuator 3 has not entered, the operating rod 21 is pushed by the cam curve section 15*c* of the drive cam 15 against the coil spring and is in a condition wherein the most part thereof is sunken towards the side of the switch section 7, and the movable member 37 is being pressed upon by the operating rod 21. As a result of this, the movable contacts 39*a* and 40*a* and the fixed contacts 39*b* and 40*b* of each of the normally-closed switching contacts 39 and 40 separate, each of the normally-closed switching contacts 39 and 40 is in an open condition, a supply of power to the industrial machinery is cutoff, and the industrial machinery is in an inoperable condition.

Next, the lock mechanism section 8 is explained. The lock mechanism section 8 is, as shown FIG. 1, disposed inside the case member 33 and rightward of the operation section 5, and includes a lock mechanism 8*a* and a manual lock release mechanism 8*c*. It should be noted that the lock mechanism 8*a* includes the lock member 80 described above, a drive section 81 for moving the lock member 80, and normally-open and normally-closed switching contacts 85 and 86 that correspond to "lock mechanism side switching contact" of the present invention, a link member 81*d* for switching the open-close conditions of the normally-open and normally-closed switching contacts 85 and 86 in a coupled manner with the motion of the lock member 80. Also, the normally-open and normally-closed switching contacts 85 and 86 are arranged aligned in the lock switching contact section 8*b* in the front and back sides as viewed from a direction vertical to the sheet surface in FIG. 1, that is, in the front and rear sides.

The lock member 80 constituting a part of the lock mechanism 8*a* is supported by a lock member support section 801 so as to be capable of freely moving between an unlock position shown in FIG. 1 and a lock position shown in FIG. 2 in a direction substantially perpendicular to the rotating shaft 13 of the drive cam 15. Furthermore, an outer diameter of a tip section 80*a* of the lock member 80 is structured so as to be smaller than an outer diameter of a base 80*b*. Also, when the lock member 80 moves to the lock position, a rotation of the drive cam 15 is locked as a result of the tip section 80*a* engaging with the notch cut-out section 15*b* of the drive cam 15. Meanwhile, when the lock member 80 moves to the unlock position, the engagement between the tip section 80*a* and the notch cut-out section 15*b* is released and the drive cam 15 becomes capable of rotation.

Furthermore, the drive section 81 includes a hinge-type electromagnet 81*a* formed by wrapping a coil on a core in which a working member 81*b* formed in an approximate L-shape from magnetic material such as iron, etc. is displaced when acted upon by an electromagnetic force of attraction resulting from energization of the hinge-type electromagnet 81*a*; a return spring 81*c* formed from a leaf spring and urging the working member 81*b* leftward; and the link member 81*d* transmitting displacement of the working member 81*b* to the lock member 80. The hinge-type electromagnet 81*a* is arranged such that a direction of a central axis thereof is substantially perpendicular to a motion direction of the lock member 80, and is supported by a case 82 of the lock switching contact section 8*b*. Furthermore, as shown in FIG. 1, the hinge-type electromagnet 81*a* is supported by the case 82 so as to produce a gap 83 between the hinge-type electromagnet 81*a* and the case 82, and the working member 81*b* and the return spring 81*c* are provided in the gap 83.

The working member 81*b* is a member formed in an approximate L-shape such that a bend section 81*b*1 thereof has an obtuse angle, and is provided within the gap 83 so as to be capable of freely swinging with the bend section 81*b*1 portion as a central axis of swinging. Furthermore, the return spring 81*c* is disposed rightward of the working member 81*b* within the gap 83 such that the urging force thereof works in a leftward direction. Furthermore, the link member 81*d* is connected to (engaged with) an upper end section 81*b*2 of the working member 81*b*, and the lock member 80 is pivotally supported by the link member 81*d*.

Accordingly, as shown in FIG. 2, if energization of the hinge-type electromagnet 81*a* is shutoff, the working member 81*b* is urged leftward by the return spring 81*c* and the upper end section 81*b*2 moves leftward with the bend section 81*b*1 portion as a central axis of swinging. Also, pursuant to the leftward motion of the upper end section 81*b*2, the link member 81*d* connected to the upper end section 81*b*2 moves leftward, and the lock member 80 pivotally supported by the link member 81*d* moves in an arrow direction of FIG. 2, or in other words, towards the lock position. The link member 81*d* may be moved leftward using only the urging force of a terminal plate as a plate spring including movable contacts 85*a* and 86*a* described later. Meanwhile, if the hinge-type electromagnet 81*a* is energized, a bottom-left end section 81*b*3 of the working member 81*b* is drawn to the hinge-type electromagnet 81*a* by the electromagnetic force of attraction of the hinge-type electromagnet 81*a*. As a result, the upper end section 81*b*2 of the working member 81*b* moves rightward against the urging force of the return spring 81*c* with the bend section 81*b*1 as a central axis of swinging. Also, pursuant to the rightward motion of the upper end section 81*b*2, the link member 81*d* connected to the upper end section 81*b*2 moves rightward, and the lock member 80 pivotally supported by the link member 81*d* moves in an arrow direction of FIG. 3, or in other words, towards the unlock position. In this manner, in the present embodiment, the link member 81*d* functions as a "transmission section" of the present invention.

Additionally, as shown in FIG. 5, the normally-open switching contact 85 and the normally-closed switching contact 86 are provided aligned at the front side and the back side of the case 82 of the lock switching contact section 8*b*, respectively. These normally-open and normally-closed switching contacts 85 and 86 include the movable contacts 85*a* and 86*b*, and the fixed contacts 85*b* and 86*b*, respectively. The lower end portion of the terminal plate that includes these contacts is supported by the case 82 so that these contacts are arranged in the case 82. In the normally-open switching contact 85, the movable contact 85*a* is arranged to the left of the fixed contact 85*b*, and in the normally-closed switching contact 86, the movable contact 86*a* is arranged to the right of the fixed contact 86*b*. Upper end sections 85*a*1 and 86*a*1 of the terminal plate on the side toward the movable contacts 85*a* and 86*a* are respectively engaged with the above-described link member 81*d*. Therefore, these movable contacts 85*a* and 86*a* simultaneously move in the same direction in a coupled manner with the motion of the link member 81*d*. Also, in the present embodiment, the link member 81*d* is provided connecting the above-described lock member 80 to the movable contacts 85*a* and 86*a*. Consequently, when the link member 81*d* moved in the direction of the arrow LK and the lock member 80 has moved to the lock position (see FIG. 2), the normally-open and normally-closed switching contacts 85 and 86 simultaneously become an open and a closed conditions, respectively (see FIGS. 5A2 and 5B2). When the link member 81*d* moved in the direction of the arrow UL and the lock member has moved to the unlock position (see FIGS. 1 and 3), the normally-open and normally-closed switching contacts 85 and 86 simultaneously become a closed and an open conditions, respectively.

Also, in the present embodiment, the link member 81*d* that engages with the upper end section 81*b*2 of the working member 81*b* connects the lock member 80 and the movable contacts 85*a* and 86*a*, and therefore, displacement of the upper end section 81*b*2 of the working member 81*b* caused by the electromagnetic force of attraction of the hinge-type electromagnet 81*a* is simultaneously transmitted to the lock member 80 and the movable contacts 85*a* and 86*a* via the link member 81*d*, and they simultaneously move. And as explained above, for example, the normally-closed switching contact 86 within the case 82 is connected in series with the first normally-closed switching contact 39 connected to the industrial machinery of the switching contacts provided in the switching contact section 70. Furthermore, an operation of the lock member 80 can be detected by monitoring an electrical signal of the normally-open switching contact 85.

In addition, the manual lock release mechanism 8*c* is provided with a release cam 84 having a projection 84*a*. As shown in FIG. 2, when the lock member 80 moves to the lock position and the lock member 80 becomes engaged with the notch cut-out section 15*b*, the locked state can be released by rotating the release cam 84 clockwise from the exterior of the switch main unit 1 using, for example, a release key. That is to say, by rotating the release cam 84 clockwise, the link member 81*d* can be moved rightward while the projection 84*a* making sliding contact with the link member 81*d*. As a result, pursuant to the rightward motion of the link member 81*d*, the lock member 80 pivotally supported by the link member 81*d* also moves rightward in a coupled manner, the engagement condition between the lock member 80 and the notch cut-out section 15*b* is released, and the drive cam 15 can be made capable of rotating.

Next, an operation is explained. As shown in FIG. 1, when the actuator 3 has not entered the operation section 5 of the switch main unit 1, the operating rod 21 is pushed by a large diameter portion of the cam curve section 15*c* of the drive cam 15 against the coil spring and is in a condition wherein the most part thereof is sunken towards the side of the switch section 7, and the movable member 37 is being pressed upon by the operating rod 21. As a result of this, the movable contacts 39*a* and 40*a* and the fixed contacts 39*b* and 40*b* of the normally-closed switching contacts 39 and 40 separate, and each of the normally-closed switching contacts 39 and 40 is in an open condition. Accordingly, a supply of power to the industrial machinery is cutoff, and the industrial machinery is in an inoperable condition. Furthermore, the lock member 80 is pushed against the return spring 81*c* by an outer periphery portion of the drive cam 15 and has moved to the unlock position, and the normally-open and normally-closed switching contacts 85 and 86 of the lock switching contact section 8*b* are closed and open, respectively, as shown in FIGS. 5A1 and 5B1.

Next, when the actuator 3 enters the operation section 5 as a result of closure of a protective door, etc., as shown in FIG. 2, the connecting piece 3*c* of the actuator 3 engages with the engaging section 15*a* of the drive cam 15, and pursuant to entry of the actuator 3, the drive cam 15 is rotated clockwise. Pursuant to the rotation of drive cam 15, the operating rod 21 moves upward as a result of the urging force of the coil spring while a tip thereof making sliding contact from a large diameter portion to a small diameter portion of the cam curve section 15*c*. Pursuant to the upward motion of the operating rod 21, the normally-closed switching contacts 39 and 40 change from an open condition to a closed condition. Furthermore, the notch cut-out section 15*b* moves to a position opposing the lock member 80 pursuant to the rotation of the drive cam 15, and consequently, the lock member 80 moves leftward as a result of the urging force of the return spring 81*c*, the notch cut-out section 15*b* and the tip section 80*a* of the lock member 80 become engaged, rotation of the drive cam 15 is locked, and extraction of the actuator 3 is prevented. By the lock member 80 moving to the lock position, as shown in FIGS. 5A2 and 5B2, the normally-open and normally-closed switching contacts 85 and 86 of the lock switching contact section 8*b* are switched respectively to an open and a closed condition. Accordingly, the normally-closed switching contact 86 of the lock switching contact section 8*b* and the first normally-closed switching contact 39 are simultaneously in a closed condition, and therefore, a supply of power is provided to industrial machinery such as robots connected in series with these normally-closed switching contacts, and the industrial machinery can operate.

Figure 3:
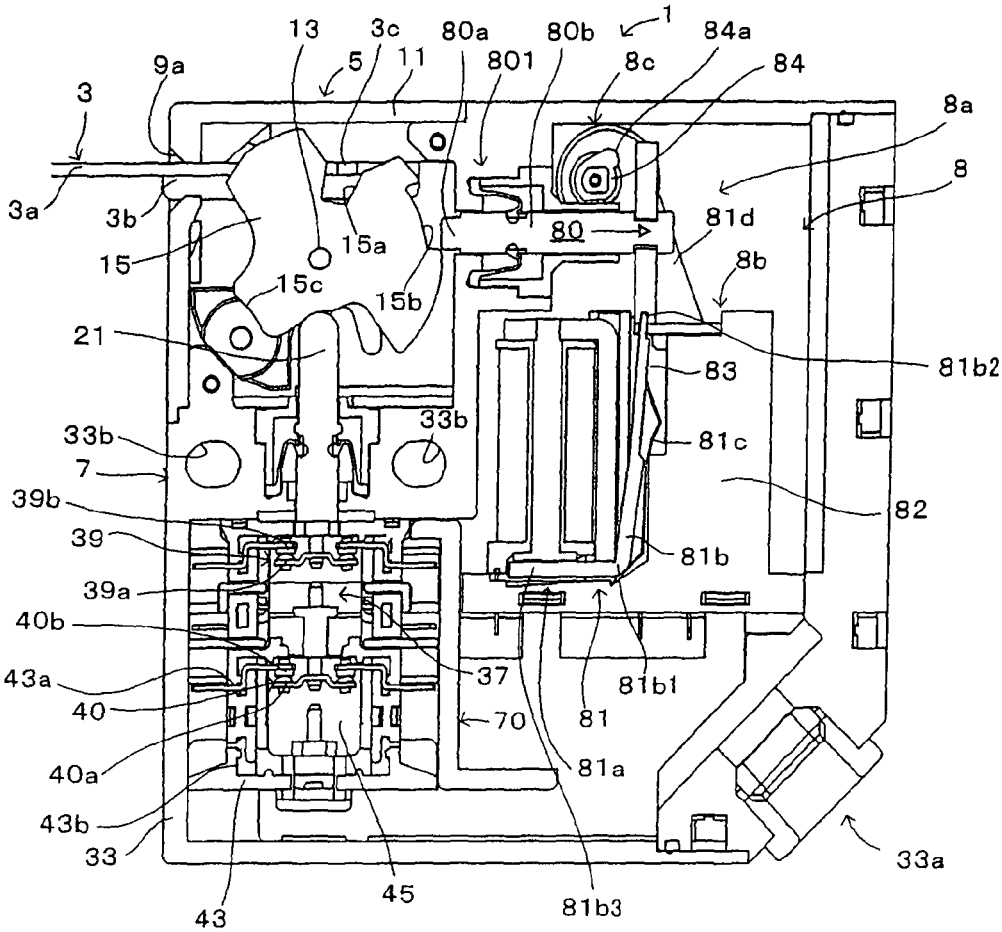
FIG. 3 is a cross-sectional view of the switch main unit according to the first embodiment of the present invention.

Next, when the hinge-type electromagnet 81*a* is energized as a result of external control, as shown in FIG. 3, the bottom-left end section 81*b*3 of the working member 81*b* is drawn towards the hinge-type electromagnet 81*a* by the electromagnetic force of attraction of the hinge-type electromagnet 81*a*. Consequently, the upper end section 81*b*2 of the working member 81*b* moves rightward against the urging force of the return spring 81*c* with the bend section 81*b*1 as a central axis of swinging, and as a result, the lock member 80 moves to the rightward unlock position pursuant to the rightward motion of the link member 81*d*. Accordingly, the engagement condition between the lock member 80 and the notch cut-out section 15*b* is released, and the locked state of the rotation of the drive cam 15 is released, the actuator 3 becomes capable of withdrawal, and the protective door, etc. can be opened. Pursuant to the motion of the lock member 80 to the unlock position, as shown in FIGS. 5A1 and 5B1, the normally-open and normally-closed switching contacts 85 and 86 of the lock switching contact section 8*b* are switched respectively to a closed and an open condition. As a result, a supply of power to industrial machinery connected in series with the normally-closed switching contact 86 of the lock switching contact section 8*b* and the first normally-closed switching contact 39 is cutoff, and the industrial machinery becomes inoperable. Also, this unlocked state can be detected by an electrical signal passing through the normally-open switching contact 85 of the lock switching contact section 8*b*.

Figure 4:
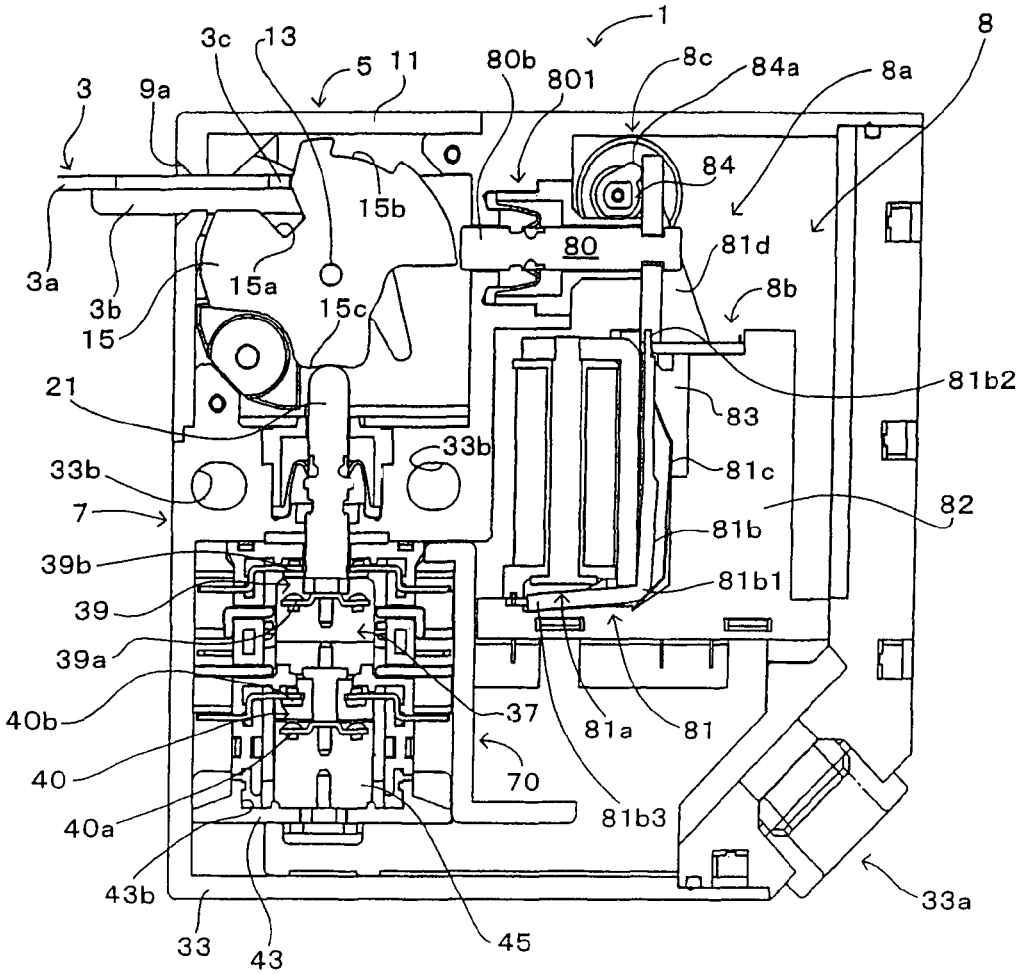
FIG. 4 is a cross-sectional view of the switch main unit according to the first embodiment of the present invention.

The following is a detailed description of a situation wherein an attempt is made to forcibly withdraw and extract the actuator 3 from the operation section 5 with, as shown in FIG. 2, the rotation of the drive cam 15 in a locked state, with reference to FIGS. 2 and 4. As the connecting piece 3*c* of the actuator 3 is engaged with the engaging section 15*a* of the drive cam 15, when the actuator 3 is forcibly withdrawn, a forcible rotation force is applied to the drive cam 15. At this time, the tip section 80*a* of the lock member 80 remains engaged with the notch cut-out section 15*b* of the drive cam 15, and therefore, a force of extraction of the actuator 3 is concentrated in a portion of engagement of the tip section 80*a*, engaged with the drive cam 15, and the notch cut-out section 15*b*. Also, if the actuator 3 is forcibly extracted from the switch main unit 1, as the diameter of the tip section 80*a* is set small so as to set the fracture strength of the tip section 80*a* lower than the fracture strength of the notch cut-out section 15*b*, the tip section 80*a* of the lock member 80 of lower fracture strength breaks before the notch cut-out section 15*b* of the drive cam 15, and the drive cam 15 becomes capable of rotation.

Then, pursuant to withdrawal of the actuator 3 from the operation section 5, the drive cam 15 is rotated in a counter-clockwise direction and the connecting piece 3*c* of the actuator 3 comes free of the engagement condition with the engaging section 15*a*. At this time, as shown in FIG. 4, as the cam curve section 15*c* of the drive cam 15 and the operating rod 21 are in a normal condition and free of breakage, pursuant to the counter-clockwise rotation of the drive cam 15, the operating rod 21 moves downward against the urging force of the coil spring while making sliding contact from a small diameter portion to a large diameter portion of the cam curve section 15*c*. Also, pursuant to the downward motion of the operating rod 21, the normally-closed switching contacts 39 and 40 of the switching contact section 70 adopt an open condition normally. That is to say, the normally-closed switching contacts 39 and 40 provided in the switching contact section 70 are operating normally, and therefore, based on the condition of these normally-closed switching contacts 39 and 40, extraction (withdrawal) of the actuator 3 is detected and a supply of power to the industrial machinery is surely and reliably cutoff.

As described above, in the present embodiment, the link member 81*d* directly and simultaneously switches the open-close conditions of the normally-open and normally-closed switching contacts 85 and 86 pursuant to the motion of the lock member 80. Therefore, the open-close conditions of the normally-open and normally-closed switching contacts 85 and 86 can be reliably switched in a manner coupled with the motion of the lock member 80 between the lock position and the unlock position. As a result, the link member 81*d* reliably switches the open-close conditions of the normally-open and normally-closed switching contacts 85 and 86 provided in the lock switching contact section 8*b* in a manner coupled with the motion of the lock member 80 between the lock position and the unlock position. Therefore, for example, by monitoring the open-close conditions of the normally-open and normally-closed switching contacts 85 and 86, it is possible to determine to which of the lock position and the unlock position the lock member 80 has moved, that is, which of the locked state and the unlocked state the rotation of the drive cum 15 is in.

Also in the present embodiment, the movable contacts 85*a* and 86*a* of the normally-open and normally-closed switching contacts 85 and 86 are connected to the lock member 80 via the link member 81*d*. Therefore, the open-close conditions of the normally-open and normally-closed switching contacts 85 and 86 can be reliably and simultaneously switched as a result of the movable contacts 85*a* and 86*a* moving simultaneously via the link member 81*d*, in a coupled manner with the motion of the lock member 80. In addition, for example if fusion occurs to the contact of one of the normally-open and normally-closed switching contacts 85 and 86, and makes it impossible for the fused movable contact to normally move, the link member 81*d* connected to the fused movable contact cannot move either. For this reason, the movable contact of the other normal switching contact similarly connected to the link member 81 does not move either. Accordingly, when one of the switching contacts is subject to a problem, the other switching contact can be prevented from operating normally, and therefore, it is possible for the normally-open and normally-closed switching contacts 85 and 86 to reliably keep the opposite open-close conditions.

Furthermore, in this embodiment, the hinge-type electromagnet 81*a* is arranged such that a direction of the core (central axis) thereof is substantially perpendicular to a motion direction of the lock member 80 between the lock position and the unlock position, and the lock member 80 is moved by transmitting the electromagnetic force of attraction generated by energizing the hinge-type electromagnet 81*a* to the lock member 80 with the direction of working thereof deflected via the working member 81*b* and the link member

81*d*. Therefore, in comparison, for example, to usage of the electromagnetic force of attraction in a straight-line fashion such as by a plunger-type electromagnet, it is possible to realize a thinner, and more compact entire safety switch. It should be noted that it is possible to engage the working member 81*b* with the lock member 80 so as to transmit the displacement of the working member 81*b* to the link member 81*b* and the movable contacts 85*a* and 86*a* via the lock member 80. In this case, the working member 81*d* functions as the "transmission section" of the present invention.

In the present embodiment, the link member 81*d* is engaged with the working member 81*b*, and the displacement of the working member 81*b* is transmitted to the lock member 80 and the movable contacts 85*a* and 86*a* via the link member 81*b*. Therefore, the electromagnetic force of attraction generated by energizing the hinge-type electromagnet 81 is transmitted to the lock member 80 and the lock mechanism side switching contacts the via the link member 81*d* engaged with the working member 81*b*, which makes it possible to reliably open and close the lock mechanism side switching contacts with a fewer components.

Furthermore, in this embodiment, the switch main unit 1 has a rectangular parallelepiped shape, and the actuator entry opening 9*a* is formed at one of a pair of opposing corner portions of the switch main unit 1 and the cable extraction opening 33*a* is formed at the other corner portion. For this reason, as shown in FIGS. 6A and 6B, the relationship between the actuator entry opening 9*a* and the cable extraction opening 33*a* realizes a high degree of freedom in terms of a cable extraction direction, and the safety switch can be provided on a wall surface or on a protective door; furthermore, the actuator entry opening can be arranged so as to be horizontal or vertical. Furthermore, either a front or rear surface of the safety switch can be attached to the mounting location. Accordingly, a degree of freedom with regard to mounting of the safety switch is increased, and a wider range of safety switch mounts is available. Furthermore, as such a configuration increases the degree of freedom with regard to safety switch mounting, it is acceptable to not provide two actuator entry openings as in the conventional technology, and therefore, it is possible to prevent breakage of the safety switch as a result of the entry of dust, etc. from the actuator entry opening on the unused side, and to also improve the durability of the safety switch. It should be noted that FIG. 6A is a view with a front surface of a safety switch on a top side, and FIG. 6B is a view with a back surface of a safety switch on a top side.

Also, in this embodiment, even when the lock member 80, which has lower fracture strength, breaks as a result of forcibly withdrawing and extracting the actuator 3 from the operation section 5 with rotation of the drive cam 15 locked, and consequently the drive cam 15 becomes capable of rotation, the cam curve section 15*c* of the drive cam 15 and the operating rod 21 are in a normal condition and free of breakage. Therefore, when the drive cam 15 is rotated in a counter-clockwise direction pursuant to withdrawal of the actuator 3 from the operation section 5 and the connecting piece 3*c* of the actuator 3 comes free of the engagement condition with the engaging section 15*a*, the operating rod 21 moves downward while making sliding contact from a small diameter portion to a large diameter portion of the cam curve section 15*c*. Also, since the normally-closed switching contacts 39 and 40 of the switching contact section 70 switch normally to an open condition pursuant to this downward motion of the operating rod 21, extraction (withdrawal) of the actuator 3 can be detected based on this condition of the normally-closed switching contacts 39 and 40. Accordingly, even in a situation wherein a protective door, etc. is forcibly opened without the lock being released normally and the actuator 3 is extracted from the switch main unit 1, withdrawal of the actuator 3 from the switch main unit 1 can be detected in a sure and reliable manner.

Furthermore, in this embodiment, as the fracture strength of the tip section 80*a* of the lock member 80 is set lower than the fracture strength of the notch cut-out section 15*b* of the drive cam 15, the tip section 80*a* of the lock member 80 is more liable to break than the notch cut-out section 15*b* of the drive cam 15. For this reason, even if the tip section 80*a* of the lock member 80 breaks, replacement of the broken lock member 80 alone makes it possible for the safety switch to again be used in a normal condition, and therefore, a cost reduction can be realized.

Furthermore, in this embodiment, as detection of a condition of entry and withdrawal of the actuator 3 with respect to the operation section 5 is carried out using an electrical signal resulting from opening and closing of the normally-closed switching contacts 39 and 40 provided in the switching contact section 70, entry and withdrawal of the actuator 3 can be detected from the exterior using the electrical signal resulting from opening and closing of the normally-closed switching contacts 39 and 40.

Furthermore, in this embodiment, since the provision and cutting off of a supply of power to the industrial machinery is carried out using two normally-closed switching contacts 39 and 40 and based on an open-close operation thereof, for example, in a situation in which the movable contacts 39*a* and 40*a* and the fixed contacts 39*b* and 40*b* of the normally-closed switching contacts 39 and 40 have fused while a supply of power is provided to the industrial machinery with the normally-closed switching contacts 39 and 40 closed, the fused movable contacts 39*a* and 40*a* and fixed contacts 39*b* and 40*b* can be forcibly separated as a result of withdrawal of the actuator 3 and the movable member 37 being pressed upon by the operating rod 21. Therefore, the reliability of the safety switch can be improved.

Second Embodiment

Figure 7:
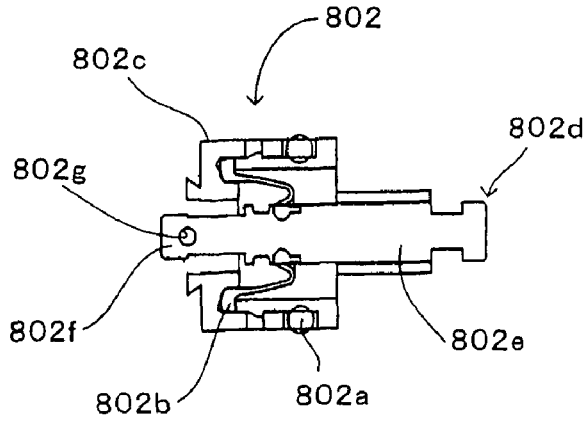
FIG. 7 is a view illustrating a lock member unit according to a second embodiment of the present invention.

FIG. 7 is a view illustrating a lock member unit according to the present invention, and the following is a detailed description of a second embodiment of a safety switch according to the present invention, with reference to FIG. 7. The major point of difference between this second embodiment and the above-explained first embodiment is that a lock member of a lock mechanism is provided as a unit and arranged so as to be capable of being freely built into and removed from a drive section, and all other configurations and operations are identical to those of the first embodiment. The following is a detailed description of the second embodiment, focusing on differences with the first embodiment, with reference to FIG. 1 as well. It should be noted that, in terms of configurations and operations that are identical to those of the first embodiment, explanation is omitted.

As shown in FIG. 7, a lock member unit 802 is configured such that a lock member 802*d* is supported by a lock member support section 802*c* and seal members 802*a*, 802*b*. Also, this lock member unit 802 is provided upward of the hinge-type electromagnet 81*a* of the drive section so as to be capable of being freely built into and removed. Furthermore, the lock member 802*d* includes a base 802*e* and a tip section 802*f* connected to the base 802*e*, and an opening 802*g* is formed at the boundary between the base 802*e* and the tip section 802*f* in order to reduce fracture strength.

In this way, since the lock member 802*d* is provided as a unit in the form of the lock member unit 802 and arranged so as to be capable of being freely built into and removed from the drive section, even in a situation in which the lock member 802*d* breaks, it is sufficient to replace this lock member unit 802 in order to restore the safety switch efficiently and in a short period of time. Furthermore, as the opening 802*g* is provided in order to reduce the fracture strength of the tip section 802*f* of the lock member 802*d*, if the actuator 3 is forcibly extracted from the switch main unit 1, the tip section 802*f* of the lock member 802*d* is surely and reliably broken first and the notch cut-out section of the drive cam can be maintained in a normal condition. Accordingly, when the safety switch is broken as a result of forcible extraction of the actuator from the main unit of the safety switch, the safety switch can be restored to a normal condition simply by replacing the lock member unit 802.

Third Embodiment

FIGS. 8A to 8D is a cross-sectional view of a lock switching contact section, and a third embodiment of the safety switch of the present invention is described in detail with reference to FIGS. 8A to 8D. The third embodiment differs from the foregoing first and second embodiments in that two normally-closed switching contacts are provided as the lock mechanism side switching contacts in the front and rear sides of the lock switching contact section 8*b*. The other configuration and operations are similar to those of the first embodiment. The following is a detailed description of the third embodiment, focusing on differences with the first embodiment, with reference to FIGS. 1 to 4 as well. It should be noted that, in terms of configurations and operations that are identical to those of the first embodiment, the corresponding reference numerals are assigned and explanation is omitted.

As shown in FIGS. 8A to 8D, normally-closed switching contacts 186 and 286 are provided aligned in the front side and the rear side of the case 82 of the lock switching contact section 8*b*, respectively. These normally-closed switching contacts 186 and 286 have movable contacts 186*a* and 286*a*, and fixed contacts 186*b* and 286*b*, respectively. The lower end portion of the terminal plate that includes these contacts is supported by the case 82 so that these contacts are arranged in the case 82. The movable contacts 186*a* and 286*a* are arranged to the right of the fixed contacts 186*b* and 286*b*, and upper end sections 186*a*1 and 286*a*1 of the terminal plate on the side toward the movable contacts 186*a* and 286*a* are respectively engaged with a link member 181*d*. Therefore, these movable contacts 186*a* and 286*a* simultaneously move in the same direction in a coupled manner with the motion of the link member 181*d*. Also, similarly to the first and second embodiments, the link member 181*d* is provided connecting the lock member 80 to the movable contacts 186*a* and 286*a*. Consequently, when the link member 181*d* moved in the direction of the arrow LK and the lock member 80 has moved to the lock position (see FIGS. 8A and 8B), the normally-closed switching contacts 186 and 286 simultaneously become a closed condition. FIGS. 8B, 8C and 8D are enlarged views of a portion enclosed with a dashed-dotted line in FIG. 8A in different conditions.

In this embodiment, the lock member 80 is directly connected to the movable contacts 186*a* and 286*a* of the normally-closed switching contacts 186 and 286 via the link member 181*d*. Therefore, the link member 181*d* moves pursuant to the motion of the lock member 80, and the movable contacts 186*a* and 286*a* of the normally-closed switching contacts 186 and 286 reliably move pursuant to the motion of the link member 181*d*. As a result, it is possible to reliably and simultaneously switch the open-close conditions of the normally-closed switching contacts 186 and 286 in a manner coupled with the motion of the lock member 80 between the lock position and the unlock position.

There may be a case in which fusion occurs to the contact of one of the normally-closed switching contacts. For example, the operation in a case is described in detail, in which fusion has occurred to the normally-closed switching contact 186 as shown in FIG. 8C. When the hinge-type electromagnet 81*a* is energized as a result of external control, as shown in FIG. 3, the bottom-left end section 81*b*3 of the working member 81*b* is drawn towards the hinge-type electromagnet 81*a* by the electromagnetic force of attraction of the hinge-type electromagnet 81*a*. Therefore, although the upper end section 81*b*2 of the working member 81*b* attempts to move rightward against the urging force of the return spring 81*c* with the bend section 81*b*1 as a central axis of swinging, the link member 181*d* cannot move rightward since the normally-closed switching contact 186 has fused, and consequently, the lock member 80 cannot move to the rightward unlock position. Accordingly, the engagement condition between the lock member 80 and notch cut-out section 15*b* is not released, and the rotation of the drive cam 15 remains locked. For this reason, the actuator 3 remains impossible to withdraw, which keeps opening the protective door, etc., impossible. In such case, there is a possibility that the operator misunderstands that the drive cum 15 is in an unlocked state while it is actually in a locked state, and forcibly opens the protective door, etc., to access the industrial machinery.

However, in this embodiment, the configuration is such that when the hinge-type electromagnet 81*a* is energized as a result of external control, as shown in FIG. 8C, the terminal plate on the side toward the fused movable contact 186*a* of the normally-closed switching contact 186 is somewhat distorted so that the link member 181*d* can slightly move in the direction of the arrow in FIG. 8C. As a result, as shown in FIG. 8D, the movable contact 286*a* of the normally-closed switching contact 286 slightly moves in the direction of the arrow in FIG. 8D, and the normally-closed switching contact 286 is switched to an open condition. Therefore, for example, as a double countermeasure for a case in which fusion has occurred to the contact of one of the normally-closed switching contacts, it is possible to reliably determine whether the hinge-type electromagnet 81*a* is energized as a result of external control, or any problem has occurred to the lock switching contact section 8*b*, by simultaneously monitoring the open-close conditions of the normally-closed switching contacts 186 and 286. Specifically, when the open-close conditions of the normally-closed switching contacts 186 and 286 are opposite, it is possible to determine that a problem has occurred to one of the normally-closed switching contacts 186 and 286.

In addition, by connecting in series the industrial machinery and the first normally-closed switching contact 39, the normally-closed switching contacts 186 and 286, when the hinge-type electromagnet 81*a* is energized, even if fusion has occurred to the contact of the normally-closed switching contact 186 for example, the normally-closed switching contact 286 is reliably switched to an open condition. Consequently, a supply of power to the industrial machinery is reliably cutoff so as to make the industrial machinery inoperable. Therefore, even if the operator misunderstands that the safety switch is in an unlocked state, and forcibly opens the protective door, etc., the safety of the operator can be assured since the industrial machinery is reliably made inoperable.

In this embodiment, it is naturally possible to employ the lock member unit 802 as in the foregoing second embodiment.

Fourth Embodiment

FIGS. 9A to 9D is a cross-sectional view of a lock switching contact section, and a fourth embodiment of the safety switch of the present invention is described in detail with reference to FIGS. 9A to 9D. The major difference between this fourth embodiment and the foregoing third embodiment lies in the engagement condition between the link member and the movable contacts. The other configuration and operations are similar to those of the third embodiment. The following is a detailed description of the fourth embodiment, focusing on differences with the third embodiment. It should be noted that, in terms of configurations and operations that are identical to those of the third embodiment, the corresponding reference numerals are assigned and explanation is omitted.

As shown in FIG. 9B, an opening 381*d*2 whose width is slightly larger than the width of the terminal plate is provided in a link member 381*d*. Upper end section 386*a*1 and 486*a*1 in the terminal plate on the side toward movable contacts 386*a* and 486*a* are engaged with the link member 381*d* by idly passing though the opening 381*d*2. It should be noted that FIGS. 9B, 9C and 9D are enlarged views of the portion enclosed with a dashed-dotted line in FIG. 9A in different conditions. With such a configuration, since the link member 381*d* engages with the movable contacts 386*a* and 486*a* by the upper end of the terminal plate on the sides toward the movable contacts 386*a* and 486*a* idly passing through the opening 381*d*2, when the hinge-type electromagnet 81*a* is energized as a result of external control, as shown in FIG. 9C, the link member 381*d* can move in the direction shown by the arrow in FIG. 9C although slightly, by an amount corresponding to the size of the opening 381*d*2 (clearance). In addition, the terminal plate including the movable contacts 386*a* and 486*a* is formed by a leaf spring with the urging force thereof acting in the direction of the arrow in FIG. 9D. Therefore as shown in FIG. 9D, the movable contact 486*a* of a normally-closed switching contact 486 can move in the direction of the arrow, although slightly.

As a result, the normally-closed switching contact 486 is reliably switched from a closed condition to an open condition. Accordingly, for example, as a double countermeasure for a case in which fusion has occurred to the contact of one of the normally-closed switching contacts, it is possible to reliably determine whether the hinge-type electromagnet 81*a* is energized as a result of external control, or any problem has occurred to the lock switching contact section 8*b*, by simultaneously monitoring the open-close conditions of a normally-closed switching contact 386 and the normally-closed switching contact 486. Specifically, when the open-close conditions of the normally-closed switching contacts 386 and 486 are opposite, it is possible to determine that a problem has occurred to one of the normally-closed switching contacts 386 and 486, and the effect similar to the third embodiment can be achieved.

Other

A configuration is possible in which two normally-open switching contacts are provided aligned in the lock switching contact section 8*b* as shown in FIGS. 10A and 11D. Other configuration and operations are similar to those of the foregoing third and fourth embodiments, and the corresponding reference numerals are assigned and explanation thereof is omitted. It should be noted that FIGS. 10B, 10C, 10D and 11B, 11C and 11D are enlarged views of the portion enclosed with a dashed-dotted line in FIGS. 10A and 11A in different conditions. With such a configuration, the open-close conditions of these normally-open switching contacts are opposite to those of the normally-closed switching contacts in the foregoing third and fourth embodiments. When fusion occurs to the contact of any one of the normally-open switching contacts, as in the foregoing third and fourth embodiments, the open-close condition of the other normally-open switching contact is reliably switched. Therefore, it is possible to reliably determine whether the hinge-type electromagnet 81*a* is energized as a result of external control, or any problem has occurred to the lock switching contact section 8*b*, by simultaneously monitoring the open-close conditions of the normally-open switching contacts. Specifically, when the open-close conditions of the normally-open switching contacts 385 and 485 are opposite, it is possible to determine that a problem has occurred to one of the normally-open switching contacts 385 and 485, and the effect similar to the third and fourth embodiments can be achieved.

Figure 12A:
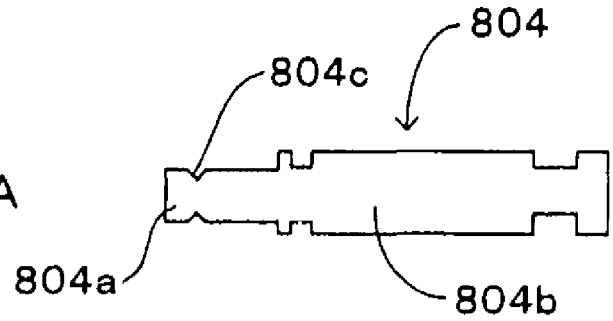
FIGS. 12A and 12B are a view illustrating a lock member according to another embodiment of the present invention.
Figure 12B:
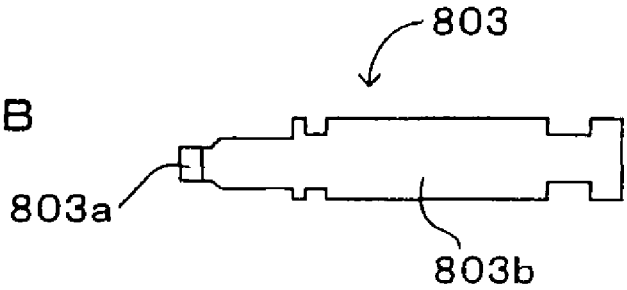
Figure 13:
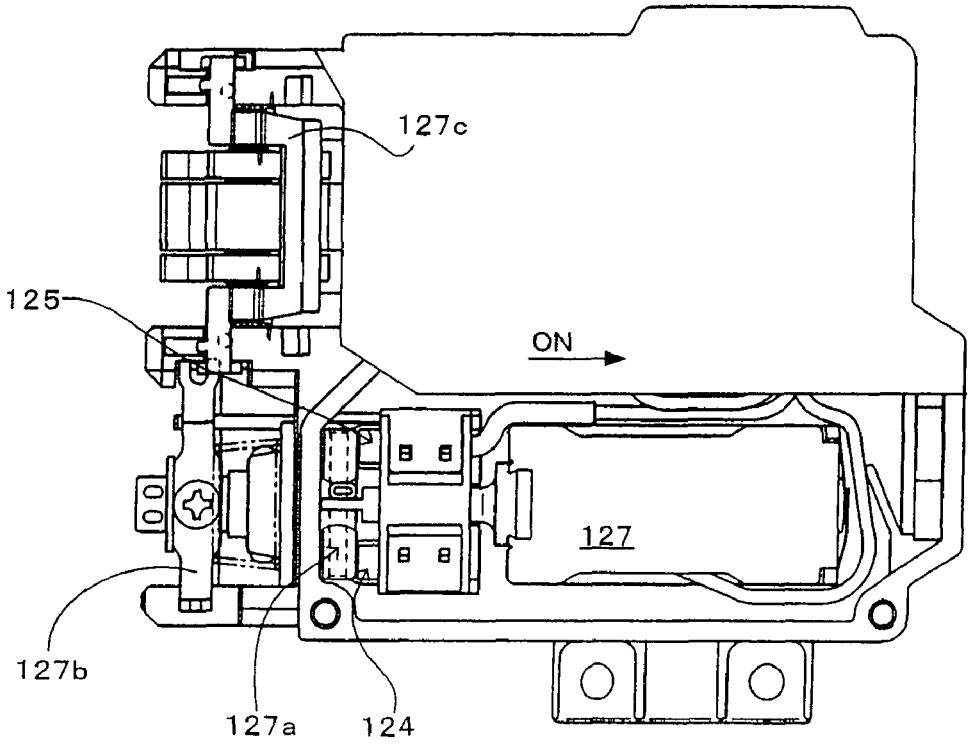
FIG. 13 is a cross-sectional view illustrating a solenoid unit of a conventional safety switch.

Furthermore, the lock member is not limited to the above-explained configuration, and for example, the various changes can be added as illustrated in FIGS. 12A and 12B. It should be noted that FIGS. 12A and 12B illustrates lock members. A lock member 804 shown in FIG. 12A includes a base 804*b* and a tip section 804*a* connected to the base 804*b*, and for example, a deficiency section 804*c* of a groove shape is formed in order to reduce fracture strength at a boundary portion between the tip section 804*a* and the base 804*b*. Furthermore, a lock member 803 shown in FIG. 12B includes a base 803*b* and a tip section 803*a* connected to the base 803*b*, and the tip section 803*a* is formed by attachment to the base 803*b*. At this time, the base 803*b* and the tip section 803*a* can either be made of the same material or different material. With such a configuration, when the actuator is forcibly extracted from the main unit of the safety switch, the tip section of the lock member, and not the notch cut-out section of the drive cam, can be broken in a sure and reliable manner. It should be noted that, in a condition in which the above-explained deficiency section is provided, it is naturally acceptable for the configuration to bond the base and the tip section.

It should be noted that the present invention is not restricted to the foregoing embodiments, and as long as there is no departure from the gist thereof, a variety of changes may be added to the above-explained configurations. For example, one of the normally-closed switching contacts provided in the switching contact section 70 may be a normally-open switching contact. In such a case, the normally-closed switching contact can be used for control of operation of an external device, and the normally-open switching contact can be a switching contact for obtaining an electrical signal for detection of entry of the actuator. With such a configuration, while the normally-closed switching contact becomes a closed condition pursuant to entry of the actuator and the external device changes from an inoperable condition to an operable condition, the normally-open switching contact becomes an open condition pursuant to entry of the actuator. In this way, in addition to entry and withdrawal of the actuator, it is possible to confirm a condition of the external device from the exterior by monitoring the open-close condition of the normally-open switching contact, which performs an opposite open-close operation to the normally-closed switching contact.

Furthermore, although two normally-closed switching contacts are provided in the switching contact section 70 in the foregoing embodiments, there is no restriction to this, and 1, 3, or 4 or more contacts can be provided. It should be noted that at least two normally-closed switching contacts are preferably provided in the switching contact section 70 in order to improve safety-switch reliability. Furthermore, as the second normally-closed switching contact 40 is configured so as to be capable of being switched to a normally-open switching contact by changing the position of the movable contact 40*a* and the fixed contact 40*b*, the configuration of the switching contact of the switch section 7 can be easily changed in accordance with intended use.

At this time, it is sufficient only to change the positions of the movable contact 40*a* and the fixed contact 40*b* when the second normally-closed switching contact 40 is switched to a normally-open switching contact, and there is no need for special components in each switching contact structure. Therefore, cost can be reduced, and in addition, it is possible to avoid incorrect assembly of components, etc. due to increase in the number of components. It should be noted that, although the foregoing embodiments are configured such that the second normally-closed switching contact 40 alone is capable of switching the switching contact structure thereof, there is no restriction to this, and the number of switching contacts capable of switching the switching contact structure thereof is arbitrary.

Furthermore, in the above-explained first and second embodiments, although the lock member 80 is moved to the lock position by a spring load (urging force) of the return spring 81*c* and the lock member 80 is moved to the unlock position by an electromagnetic force of attraction generated when the hinge-type electromagnet 81*a* is in an energized condition, the lock member 80 may be moved to the lock position using this electromagnetic force of attraction so as to put the lock mechanism 8*a* in a locked state. In this case, for example, it is preferable that a return spring be arranged such that an urging force is directed so as to move the lock member 80 to the unlock position.

In addition, in the above-described first and second embodiments, while the lock member 80 is moved by connecting the working member 81*b* to the link member 81*d* as a transmission section of the present invention, the electromagnetic force of attraction of the hinge-type electromagnet may be of course transmitted to the lock member 80 by directly engaging the working member 81*b* with the lock member 80 without using the link member 81*d*.

Also, in the above-described embodiments, two normally-open and normally-closed switching contacts are provided in the lock switching contact section 8*b* as lock mechanism side switching contacts. However, there is no limitation to this, and at least one switching contact is necessary.

In addition, a configuration is possible in which the hinge-type electromagnet is disposed such that the direction of the central axis thereof is substantially parallel to the motion direction of the lock member 80, the working member is attracted by the energized electromagnet and displaced in the same direction as the attracted direction, the transmission section further includes a urging member (such as coil spring) for urging the working member in the direction opposite to the attracted direction of the working member, and the working member is attracted to the electromagnet against the urging force of the urging member. With such a configuration, displacement of the working member that moves against the urging force of the urging member due to the electromagnetic force of attraction generated by energizing the electromagnet can be transmitted to the lock member via the transmission section so as to move the lock member. When a power supply to the electromagnet is shutoff and the electromagnetic force of attraction is lost, the urging member urges the working member so as to restore the displacement of the working member, and as a result the lock member can be moved in the direction opposite to that during energization to the electromagnet. Therefore, since it is possible to move the lock member so as to engage with and disengage from the notch cut-out section formed in the outer peripheral surface of the drive cam using a hinge-type electromagnet, which is more compact than a plunger electromagnet, the safety switch can be downsized.

It should be noted that the present invention is not restricted to the foregoing embodiments, and as long as there is no departure from the gist thereof, a variety of changes may be added to the above-explained items; furthermore, it may be widely applied in assuring the safety of workers by preventing machinery from being driven when a protective door is not completely closed.

The invention claimed is:

1. A safety switch provided with an actuator capable of entering and withdrawing from an operation section of a switch main unit, wherein a switching contact in a switch section is movable between an open condition and a closed condition through action of an operating rod provided in said switch section reciprocating in response to the entry and withdrawal of said actuator, so that the entry and withdrawal of said actuator is detected, the safety switch comprising:

a drive cam provided in said operation section and capable of rotating; and a lock mechanism provided in a lock mechanism section of said switch main unit that locks rotation of said drive cam, wherein said drive cam rotates forward and backward in response to the entry and withdrawal of said actuator with respect to said operation section, and said operating rod reciprocates due to the forward and backward rotation, and said lock mechanism comprises:

a lock member capable of moving between a locked position and an unlocked position, said lock member moving to said locked position when said actuator is in the entry condition so as to lock the rotation of said drive cam, said lock member moving to said unlocked position so as to release the locked state of the rotation of said drive cam;

a hinge-type electromagnet provided with a working member displaceable by electromagnetic force of attraction generated by energization;

said lock mechanism having at least one switching contact; and a link member consisting of one monolithic component engaged at one location on said one component with said working member and engaged at another location on said one monolithic component with said lock member, the link member moving said lock member by transmitting the displacement of said working member to said lock member via only said link member; wherein the displacement of said working member is transmitted to said switching contact of said lock mechanism via said link member so that said link member switches between an open and a closed condition of said switching contact of said lock mechanism in a manner coupled with the motion of said lock member.

2. The safety switch of claim 1, wherein said lock mechanism comprises two or more switching contacts provided with moveable contacts; and said link member connects said lock member to said movable contacts of said switching contacts of said lock mechanism.

3. The safety switch of claim 1, wherein the at least one switching contact of said lock mechanism comprises a normally-open switching contact and a normally-closed switching contact, each of the normally-open switching contact and the normally-closed switching contact having a movable contact; and said link member connects said lock member to each movable contact of said normally-open switching contact and said normally-closed switching contact.

4. The safety switch of any of claim 1 to claim 3, wherein said switch main unit has a rectangular parallelepiped shape, and an actuator entry opening is formed at one of a pair of opposing corner portions of said switch main unit, and a cable extraction opening is formed at the other of the pair of opposing corner portions, and a cable is extracted from said cable extraction opening substantially in a direction of joining said pair of opposing corner portions.

5. A safety switch provided with an actuator capable of entering and withdrawing from an operation section of a switch main unit, wherein a switching contact in a switch section is movable between an open condition and a closed condition through action of an operating rod provided in said switch section reciprocating in response to the entry and withdrawal of said actuator, so that the entry and withdrawal of said actuator is detected, the safety switch comprising:

a drive cam provided in said operation section and capable of rotating; and a lock mechanism provided in a lock mechanism section of said switch main unit that locks rotation of said drive cam, wherein said drive cam rotates forward and backward in response to the entry and withdrawal of said actuator with respect to said operation section, and said operating rod reciprocates due to the forward and backward rotation, and said lock mechanism comprises:

a lock member capable of moving between a locked position and an unlocked position, said lock member itself moving into a rotational path of said drive cam to achieve said locked position when said actuator is in the entry condition so as to block the rotation of said drive cam, said lock member moving to said unlocked position so as to release the locked state of the rotation of said drive cam;

a hinge-type electromagnet provided with a working member displaceable by electromagnetic force of attraction generated by energization;

said lock mechanism having at least one switching contact; and a link member that moves said lock member into the rotational path of said drive cam by transmitting the displacement of said working member to said lock member, wherein said working member is engaged with a part of said link member and the displacement of said working member is transmitted to said lock member to move said lock member into the rotational path of said drive cam with said link member;

wherein the displacement of said working member is transmitted to said switching contact of said lock mechanism via said link member so that said link member switches between an open and a closed condition of said switching contact of said lock mechanism in a manner coupled with the motion of said lock member.

6. The safety switch of claim 5, wherein said lock mechanism comprises two or more switching contacts provided with moveable contacts; and said link member connects said lock member to said movable contacts of said section of said lock mechanism.

7. The safety switch of claim 5, wherein the at least one switching contact of said lock mechanism comprises a normally-open switching contact and a normally-closed switching contact, each of the normally-open switching contact and the normally-closed switching contact having a movable contact; and said link member connects said lock member to each movable contact of said normally-open switching contact and said normally-closed switching contact.

8. The safety switch of claim 5, wherein said switch main unit has a rectangular parallelepiped shape, and an actuator entry opening is formed at one of a pair of opposing corner portions of said switch main unit, and a cable extraction opening is formed at the other of the pair of opposing corner portions, and a cable is extracted from said cable extraction opening substantially in a direction of joining said pair of opposing corner portions.

9. The safety switch of claim 5, wherein the link member consists of one component engaged at one location on said one component with said working member and engaged at another location on said one component with said lock member, the link member moving said lock member by transmitting the displacement of said working member to said lock member via only said link member.

* * * * *